US008714577B2

(12) United States Patent
Fournier

(10) Patent No.: US 8,714,577 B2
(45) **Date of Patent: *May 6, 2014**

(54) FLEXIBLE ERGONOMIC SPORTSBOARD WEDGES

(71) Applicant: Louis Fournier, Quebec (CA)

(72) Inventor: Louis Fournier, Quebec (CA)

(73) Assignee: William H. Bollman, Bethesda, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/862,988

(22) Filed: Apr. 15, 2013

(65) Prior Publication Data

US 2013/0228987 A1 Sep. 5, 2013

Related U.S. Application Data

(63) Continuation of application No. 12/289,175, filed on Oct. 22, 2008, now Pat. No. 8,419,043.

(60) Provisional application No. 60/960,960, filed on Oct. 22, 2007, provisional application No. 61/071,479, filed on May 1, 2008.

(51) Int. Cl.
*A63C 5/04* (2006.01)
*A63C 9/00* (2012.01)

(52) U.S. Cl.
CPC ..... *A63C 9/003* (2013.01)
USPC ..... 280/607; 280/14.22

(58) Field of Classification Search
CPC ..... A63C 9/003
USPC ..... 280/607, 613, 618, 620, 623–634, 636, 280/11.14, 11.31, 14.22, 14.24
See application file for complete search history.

(56) References Cited

U.S. PATENT DOCUMENTS

| | | | | |
|---|---|---|---|---|
| 3,332,697 | A | 7/1967 | Hagen | |
| 3,628,804 | A | 12/1971 | Carreiro | |
| 3,689,092 | A | 9/1972 | Lake | |
| 3,900,204 | A | 8/1975 | Weber | |
| 3,917,298 | A | 11/1975 | Haff | |
| 4,135,736 | A * | 1/1979 | Druss | 280/636 |
| 4,305,603 | A | 12/1981 | Mueller | |
| 4,320,905 | A | 3/1982 | Andrew | |
| 4,568,296 | A | 2/1986 | Newell | |
| 4,753,836 | A | 6/1988 | Mizell | |
| 4,902,256 | A | 2/1990 | Berglund | |
| 4,919,447 | A | 4/1990 | Jackson | |
| 4,974,868 | A | 12/1990 | Morris | |
| 5,076,604 | A * | 12/1991 | Wittmann et al. | 280/633 |

(Continued)

FOREIGN PATENT DOCUMENTS

| | | |
|---|---|---|
| DE | 3607808 | 9/1987 |
| FR | 2612792 | 9/1998 |
| WO | WO83/00311 | 2/1983 |

*Primary Examiner* — Hau Phan
*Assistant Examiner* — Jacob Meyer
(74) *Attorney, Agent, or Firm* — William H. Bollman

(57) ABSTRACT

Flexible binding wedges are provided with flexion slots cut in a widthwise direction to allow flexibility when mounted to a sportsboard such as a snowboard. "T" inserts through the wedges provide a mount for boot bindings. Flex adjustment bushings may be inserted into the slots to adjust the flexibility of the wedge when mounted on a sportsboard, e.g., a snowboard. The flexible wedges may be mounted under a top surface of the sportsboard, or even on top of the finished upper surface of the sportsboard.

12 Claims, 52 Drawing Sheets

(56) References Cited

U.S. PATENT DOCUMENTS

| | | | | |
|---|---|---|---|---|
| 5,172,924 | A | 12/1992 | Barci | |
| 5,188,386 | A | 2/1993 | Schweizer | |
| 5,328,200 | A | 7/1994 | Pelizzari | |
| 5,342,077 | A | 8/1994 | Abondance | |
| 5,366,234 | A | 11/1994 | Rohrmoser | |
| 5,427,401 | A | 6/1995 | Liard | |
| 5,529,523 | A | 6/1996 | Wilhelmi | |
| 5,556,123 | A | 9/1996 | Fournier | |
| 5,667,238 | A | 9/1997 | Sarver | |
| 5,671,939 | A | 9/1997 | Pineau | |
| 5,725,236 | A | 3/1998 | Stephanova | |
| 5,766,051 | A | 6/1998 | Messer | |
| 5,775,717 | A | 7/1998 | Bobrowicz | |
| 5,816,589 | A | 10/1998 | Southworth | |
| 5,823,562 | A | 10/1998 | Stubblefield | |
| 5,871,223 | A | 2/1999 | Zanco | |
| 5,871,224 | A | 2/1999 | Vance | |
| 5,884,934 | A | 3/1999 | DeRocco | |
| 5,910,035 | A | 6/1999 | Rebotier | |
| 5,924,718 | A | 7/1999 | Gordon | |
| 5,971,419 | A | 10/1999 | Knapschafer | |
| 5,984,343 | A | 11/1999 | Longoni | |
| 6,015,161 | A | 1/2000 | Carlson | |
| 6,089,581 | A * | 7/2000 | Partridge | 280/14.24 |
| 6,189,899 | B1 * | 2/2001 | Carlson | 280/14.22 |
| 6,341,786 | B1 | 1/2002 | Kermis | |
| 6,499,758 | B1 | 12/2002 | Fournier | |
| 6,505,841 | B1 | 1/2003 | Kessler | |
| 6,641,162 | B2 | 11/2003 | Allmann | |
| 6,786,502 | B2 * | 9/2004 | Carlson | 280/633 |
| 6,808,183 | B2 | 10/2004 | Schaller | |
| 6,817,622 | B2 | 11/2004 | Dodoge | |
| 6,910,706 | B2 | 6/2005 | Holzer | |
| 6,916,036 | B1 | 7/2005 | Egli | |
| 7,300,070 | B2 | 11/2007 | Pelchat | |
| 7,320,475 | B2 | 1/2008 | Couderc | |
| 7,334,810 | B2 | 2/2008 | Holzer | |
| 7,832,742 | B1 | 11/2010 | Duggan | |
| 2001/0038182 | A1 * | 11/2001 | Carlson | 280/14.22 |
| 2003/0094777 | A1 | 5/2003 | Fournier | |
| 2003/0146588 | A1 | 8/2003 | Fiebing | |
| 2004/0100069 | A1 | 5/2004 | Cumby | |
| 2005/0029757 | A1 | 2/2005 | Fiebing | |
| 2007/0013165 | A1 | 1/2007 | Panzeri | |
| 2008/0088100 | A1 * | 4/2008 | Wagner | 280/14.22 |
| 2009/0289439 | A1 * | 11/2009 | Carpenter | 280/618 |

* cited by examiner

FLEXIBLE ERGONOMIC SPORTSBOARD WEDGES

The present application claims priority from U.S. application Ser. No. 12/289,175 to Fournier, filed Oct. 22, 2008, entitled "Flexible Ergonomic Sportsboard Wedges", now U.S. Pat. No. 8,419,043, which in turn claims priority from U.S. Provisional Application No. 60/960,960 to Fournier, filed Oct. 22, 2007, entitled "Flexible Ergonomic Sportsboard Wedges"; and from U.S. Provisional Application No. 61/071,479 to Fournier, filed May 1, 2008, entitled "Slotted Binding Mount for Snowboard with Mount Entry via Vertical Edge", the entirety of all of which are explicitly incorporated herein by reference.

BACKGROUND OF THE INVENTION

1. Field of the Invention

The present invention relates to the field of sporting equipment. More particularly, it relates to an ergonomic mount for a sportsboard (e.g., a snowboard) used in an upright standing or kneeling position which has an ergonomic upper surface that reduces strain and wear on human joints.

2. Background of Related Art

Ergonomic foot mount concepts were first introduced by the present inventor as described in U.S. Pat. No. 6,499,758 to Fournier. Corresponding disclosure is found in Canadian Patent No. CA 2302614, and French Patent No. EP-B-1007167, which matured from PCT International Patent Appl. No. PCT/IB98/01633, the entirety of which is expressly incorporated herein by reference.

SUMMARY OF THE INVENTION

In accordance with the principles of the present invention, apparatus provides an ergonomic stance to a rider on a sportsboard, comprising a flexible wedge formed to mount over a top surface of a core of a sportsboard in a binding mounting area. The flexible wedge is shaped to angle a leg of a rider inward from a perpendicular position. A plurality of inserts are mounted through the flexible wedge. The plurality of inserts provide an area to mount a boot binding.

In accordance with another aspect of the invention, an ergonomic snowboard comprises a snowboard core, and a pair of flexible binding wedges mounted directly to the snowboard core. An upper surface is formed over both the pair of flexible binding wedges and an upper surface of the snowboard core. The flexible binding wedges have at least one transverse slot therein.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

Figure 1:
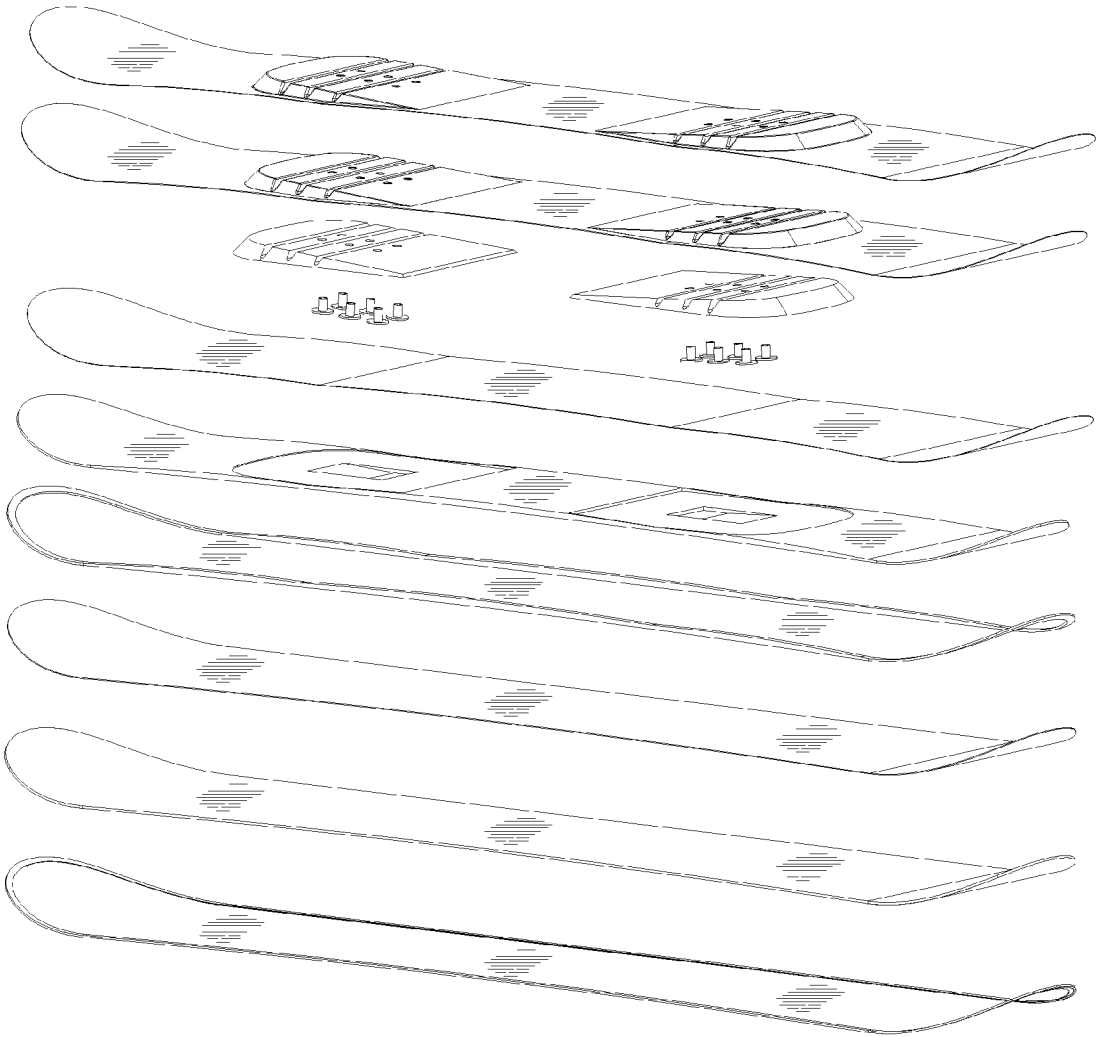
FIG. 1 is an exploded view of an exemplary assembly, in accordance with the principles of the present invention.

Flexible wedges in accordance with the principles of the present invention provide an ergonomic snowboard that can be custom produced or mass produced with a one or multiple pieces core, with existing core machining/molding/forming machines, regardless of the material.

The flexible wedges provide an ergonomic snowboard that will give same if not superior structural performances as standard ergonomic snowboard or flat standard snowboards. The flexible wedges also provide an ergonomic snowboard to be produced according to personalized anthropometric measurements per target population or individual rider, custom postural with a standard ergonomic wedge geometry that can be placed on/in any snowboard shape or construction main body.

It is preferable that the ergonomic snowboard have a same look as other actual boards except for the postural wedges. It is also desired that the ergonomic sportsboard be lightweight, and have the same surface, contour and or edges construction and finish as otherwise conventional sportsboards (e.g., snowboards).

Ergonomic wedges, e.g., snowboard flexible wedges, in accordance with the principles of the present invention can be molded or machined from virtually any appropriate material. Tnut mounting inserts are preferably inserted from below the wedge into pre-molded holes. A cavity may be machined in the planar core below (regardless of the particular material) to receive the ergonomic wedge.

Importantly, the wedges have at least one, and preferably multiple, lateral slots cut through a significant thickness of the wedge, to provide lengthwise flexibility in the wedge when mounted to an underlying sportsboard (e.g., snowboard). The lateral, flexion slot is preferably, but need not necessarily, cut through a majority of the thickness of the wedge at any given point.

The wedges may be molded, thin glass reinforced resin wedges. They may be made lightweight using a suitable rib design underneath as shown in various figures, preferably having a standard angle that will fit on a main core body.

Tnut inserts, or any other suitable anchoring means, are preferably mounted at a 90 deg angle (i.e., perpendicular) to the upper surface of the wedge.

In a given embodiment, the ergonomic wedges are independent from a main core. The wedges may be made of the same or different material from that of the main core of the sportsboard.

A reinforcing layer may be mounted above the wedges placed onto the main core, though such reinforcing layer need not be used if the wedge is otherwise securely and firmly mounted to the core of the sportsboard. In any event, an upper surface (albeit not a major reinforcement layer) such as a plastic layer is formed or otherwise placed over the wedges on the main core.

The amount of flex provided by the flexion slots in the wedge may be adjusted with the use of flex adjustment bushings. The flex adjustment bushings may fully or only partially fill any given flexion slot. Flex adjustment bushings may be of variable compression, chosen by a manufacturer, retail shop or rider, to provide a rider with a more perfect amount of flexibility in the wedge. The flex adjustment bushings may be chosen based on a rider's weight and/or abilities, and/or they may be selected based on inherent flexible properties of the relevant snowboard to which the wedge is mounted.

FIG. 1 is an exploded view of an exemplary assembly, in accordance with the principles of the present invention.

In particular, as shown in FIG. 1, otherwise conventionally known reinforcement may be implemented under the main core body of the snowboard, generally being in contact with the entire lower surface. Also, otherwise conventionally known reinforcement above the main core body may be used, in contact with the entire upper surface, and also in contact with all the surfaces of the wedge receiving cavity, provided in a disclosed embodiment by being forced into contact during a manufacturing molding forming in a press.

Preferably otherwise conventionally known reinforcement is in contact with the entire contour surface perimeter at a 90 degree angle or less, of the main core body, and/or between the main core body and the perimeter protection material, in the case of a main core body without total or partial contour protection (referred to as a cap snowboard).

In FIG. 1, conventionally known plastics materials, and/or thermoset materials, may be used to form the top or base of the snowboard, with or without cosmetics. Also, any hydro formed or mold formed non-ferrous material may be used in the top or base of the snowboard, with or without cosmetics. Surface materials can be reinforced or plain (e.g., reinforced thermoplastics), thermoformed or plain.

Figure 2:
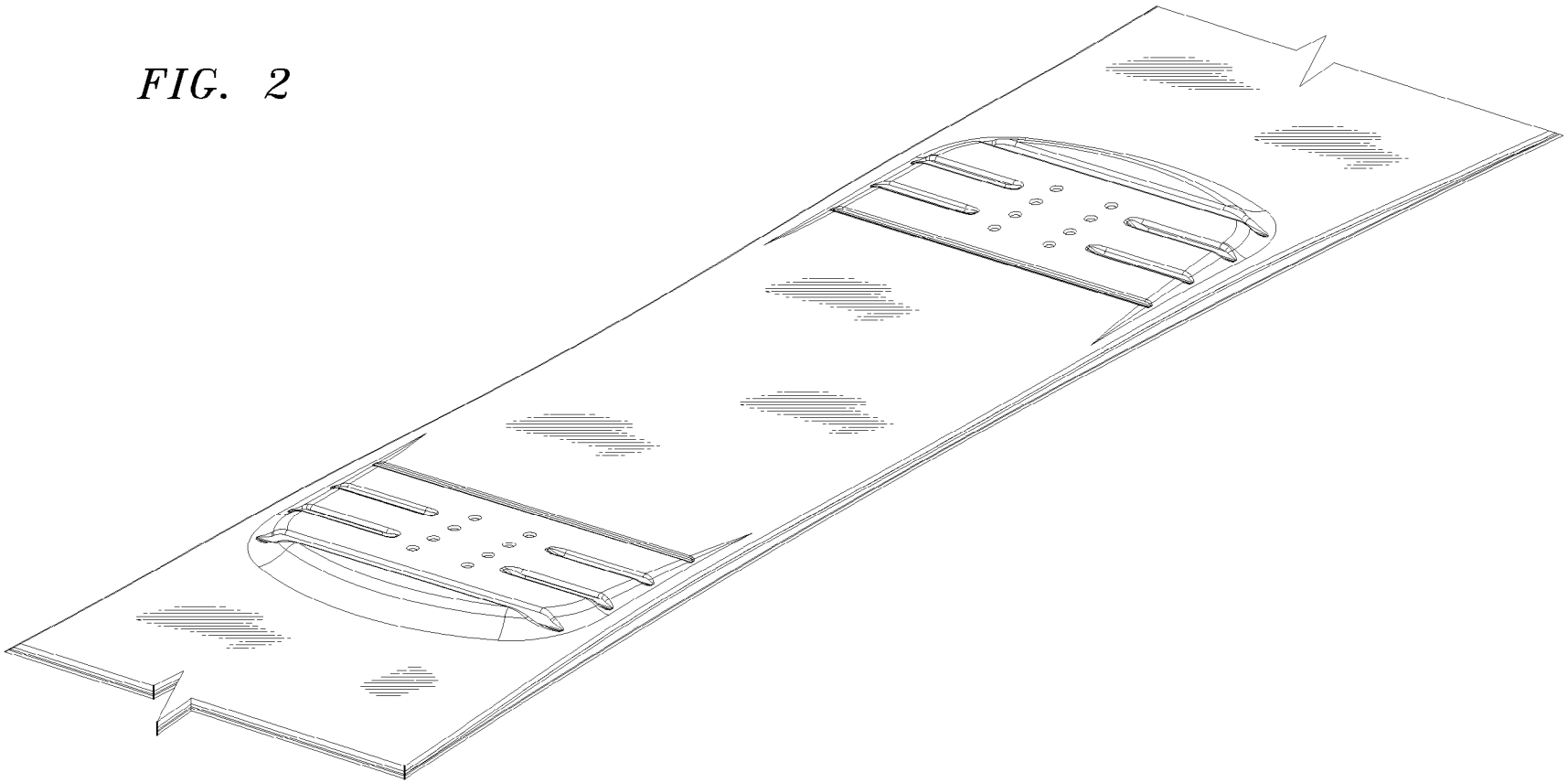
FIG. 2 is a side view showing the profile of exemplary triple bumps and inserts, in accordance with the principles of the present invention.

FIG. 2 is a side view showing the profile of exemplary triple bumps and inserts, in accordance with the principles of the present invention.

Figure 3:
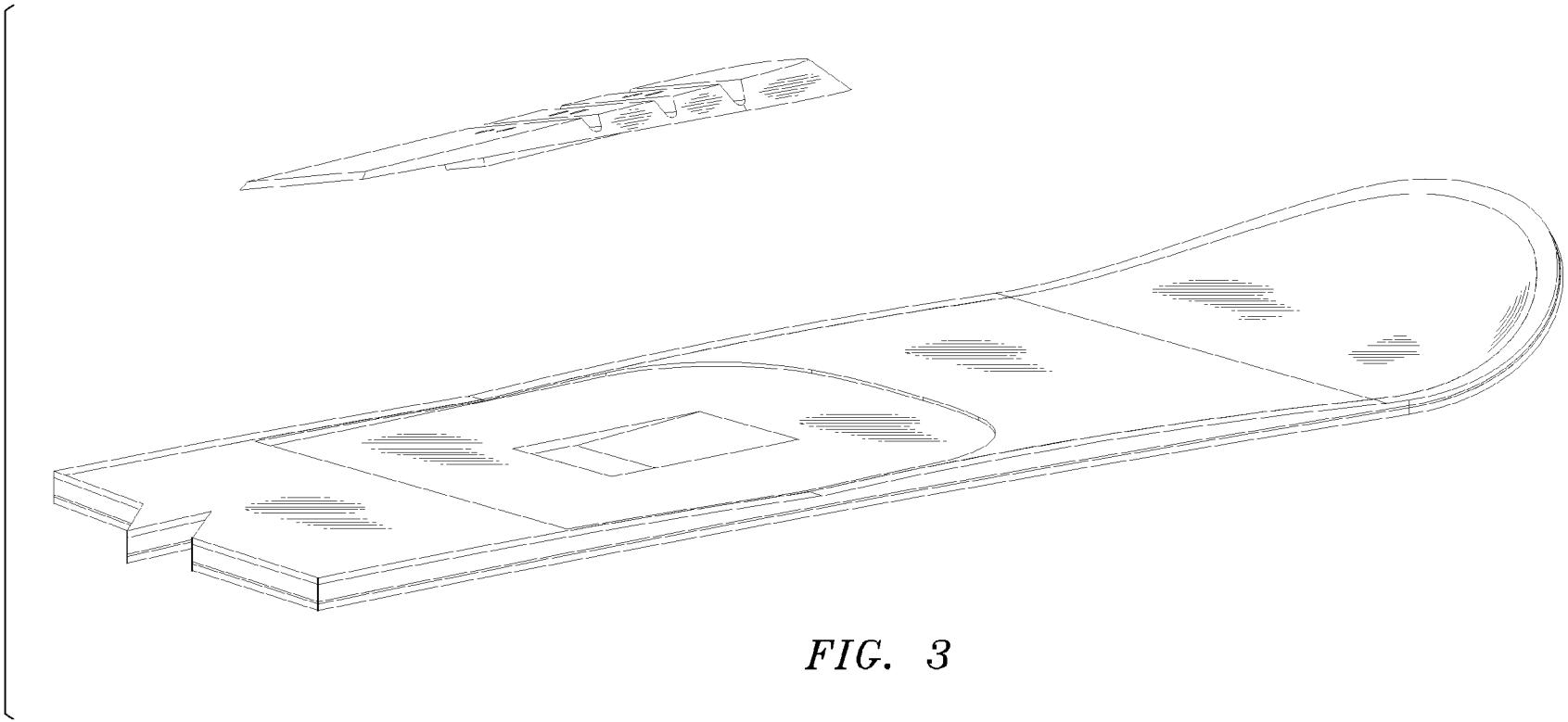
FIG. 3 depicts the flexible wedges separated from the planar portion of the core, in accordance with the principles of the present invention.

FIG. 3 depicts the flexible wedges separated from the planar portion of the core, in accordance with the principles of the present invention.

In particular, as shown in FIG. 3, the combined main core and flexible wedges may be made of any suitable material.

Figure 4:
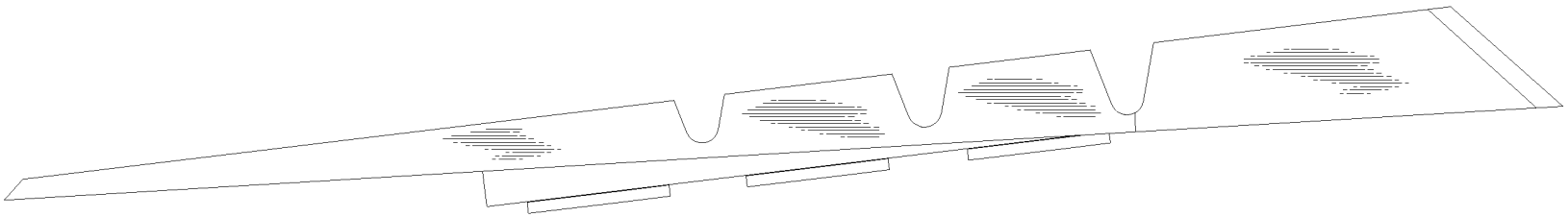
FIGS. 4A, 4B and 4C show exemplary molded wedges, in accordance with the principles of the present invention.
Figure 4B:
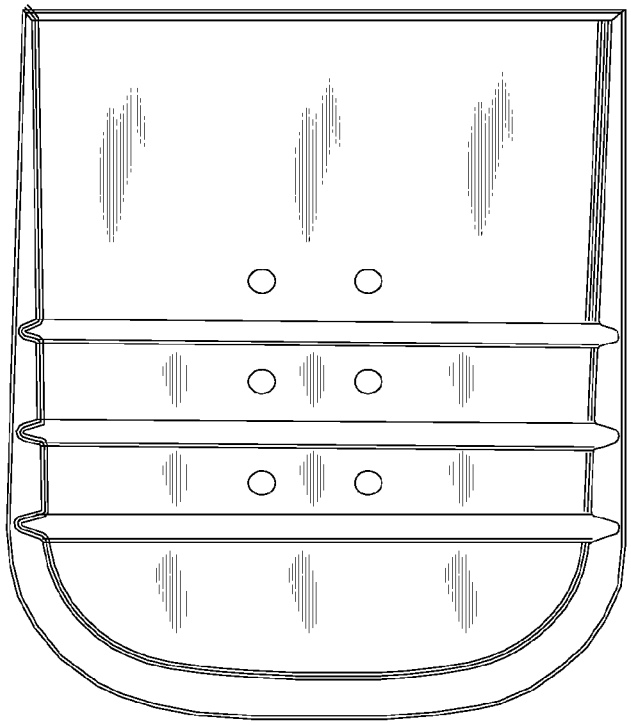
Figure 4A:
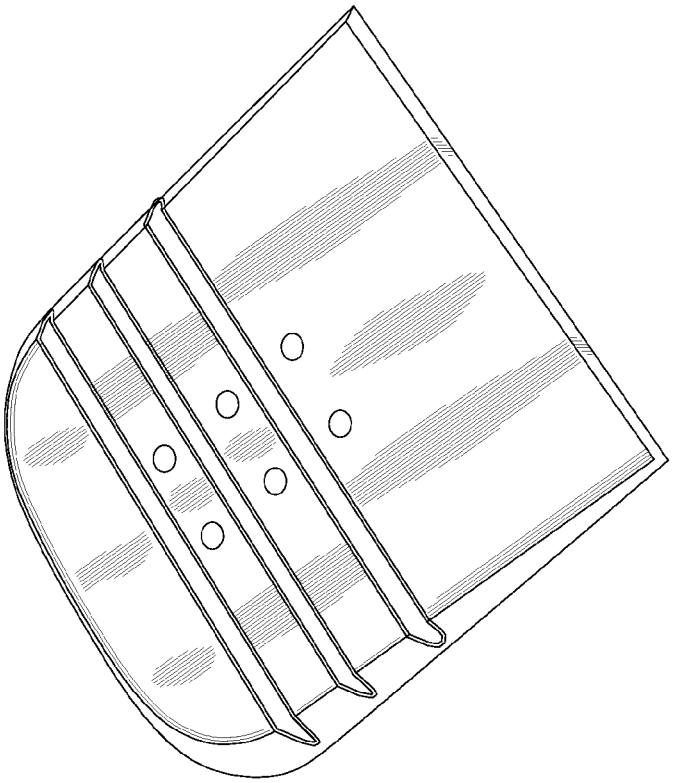
Figure 4C:
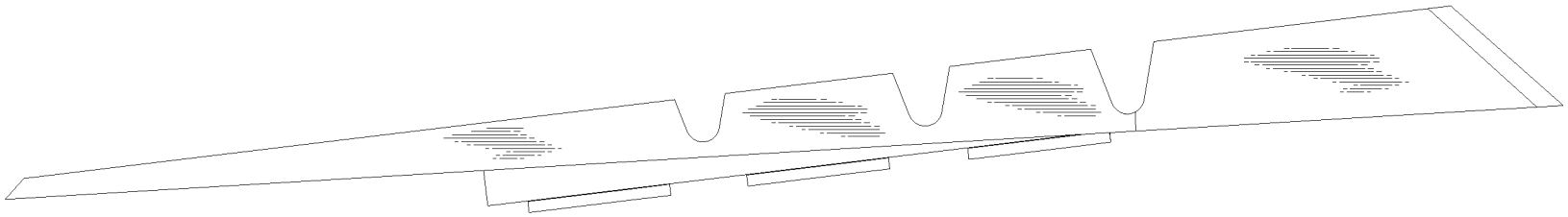

FIGS. 4A, 4B and 4C show exemplary molded wedges, in accordance with the principles of the present invention.

In particular, as shown in FIGS. 4A, 4B and 4C, flexible wedges are, machined or molded or cast in any material, reinforced or not by covering material.

As seen in FIGS. 3 and 4C, a portion of the flexible wedges, centered and below the flexible wedge, may exceed the main body of the flexible wedge to enable the insertion and alignment of the flexible wedge in a receiving main body core.

FIGS. 4A and 4B show that the flexible wedges may have one hole or many holes, in any suitable pattern. Preferably, the traversing holes are perpendicular to the top surface of the flexible wedge, even if other reinforcement or surface material covers the flexible wedge. T-inserts mounted into the traversing holes allow for the attachment of miscellaneous boot or foot binding systems commercially available.

Figure 5:
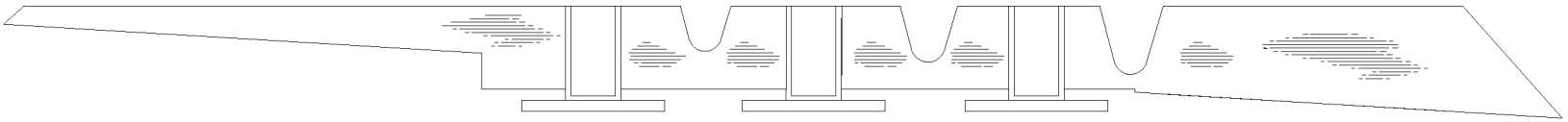
FIG. 5 shows insert mounts inserted at a 90 degree angle to the top surface of a flexible wedge, in accordance with the principles of the present invention.

FIG. 5 shows insert mounts inserted at a 90 degree angle to the top surface of a flexible wedge, in accordance with the principles of the present invention.

In particular, as shown in FIG. 5, flexible wedges preferably have a thick portion at one end that goes to nothing toward the other end in the lengthwise axis.

As shown in FIG. 5, flexible wedges have an upper plane surface or slightly curved surface that is at an angle from the gliding surface that is to say snow, or flat ground (i.e., it is not 100% planar shaped).

As shown in FIG. 5, the angle formed by the flexible wedge (with respect to the general horizontal plane of the sportsboard) is preferably between 0.5 degrees to 20 degrees as seen from a side view, and preferably between 1 to 10 degrees as seen from a front aligned view.

Figure 6:
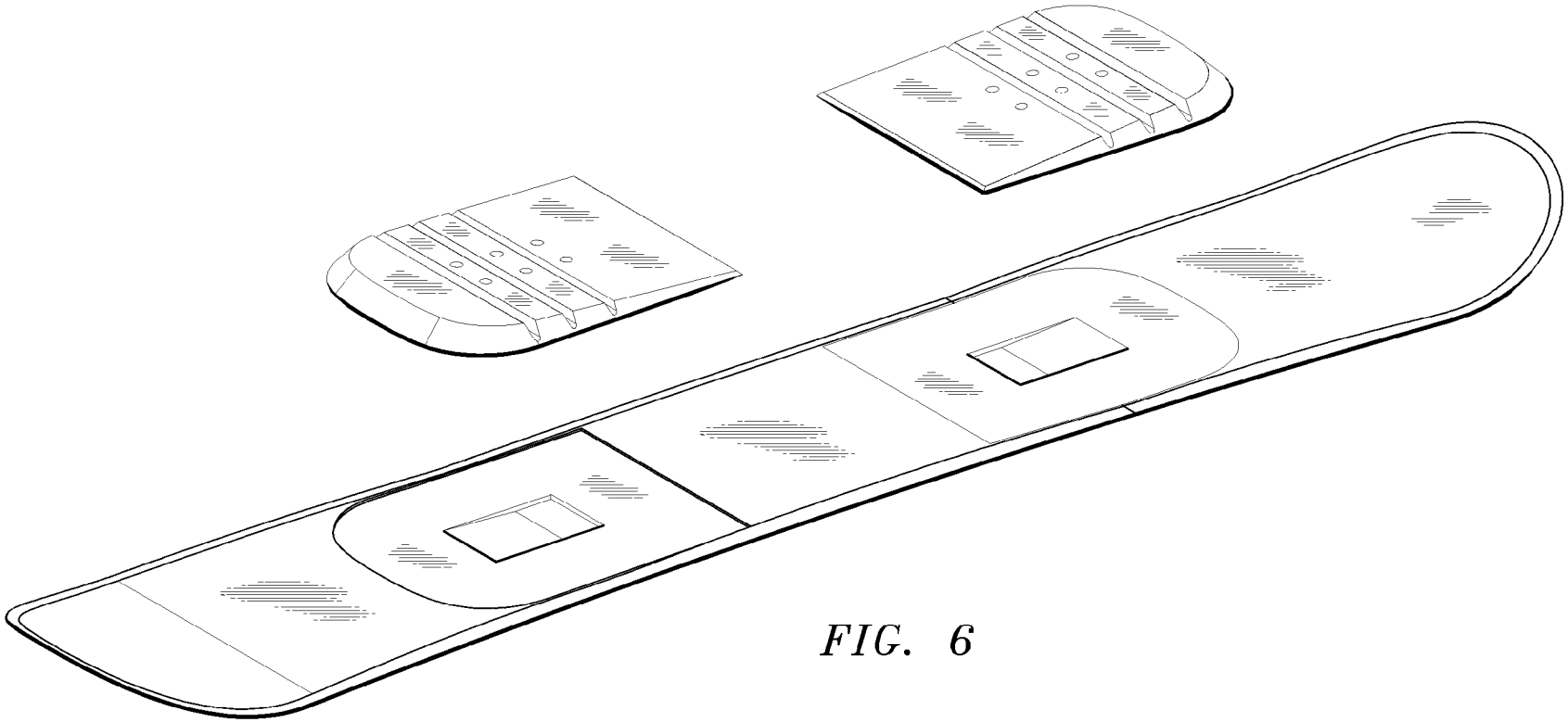
FIG. 6 shows flexible wedges above the planar core, depicting exemplary contours, in accordance with the principles of the present invention.

FIG. 6 shows flexible wedges above the planar core, depicting exemplary contours, in accordance with the principles of the present invention.

In particular, as shown in FIG. 6, flexible wedges are installed on a main core body with a thin portion toward the center of the main body.

As shown in FIG. 6, the upper surface of the main core body may include a machined, or molded in, or grooved in, cavity or cavities to receive the lower portion of the flexible wedges, in accordance with the principles of the present invention. The cavity in the main core body may go all the way through the main core body in some embodiments of the invention.

The main core body can have its entire perimeter or partial perimeter protected by a waterproof contour, generally of plastic or reinforced plastic, or any other impact resistant and waterproof material.

Figure 7:
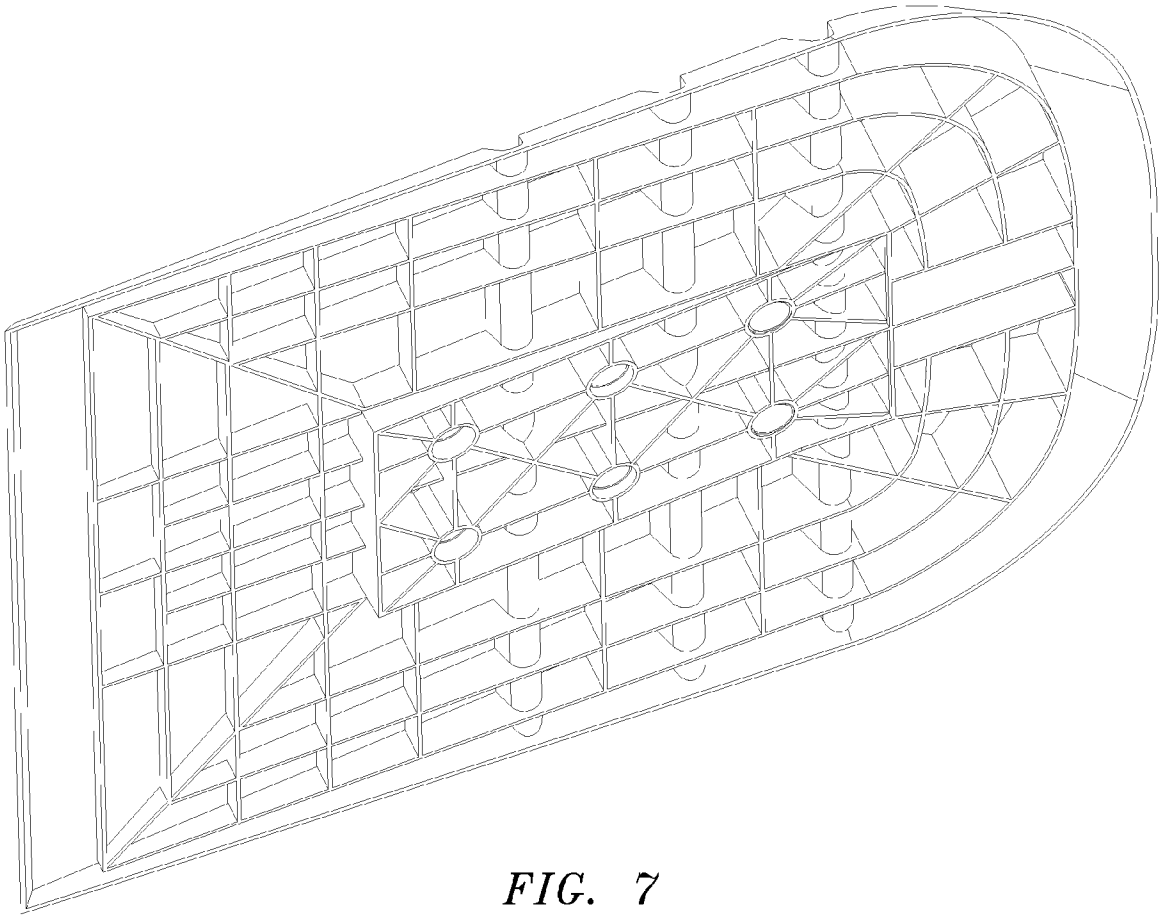
FIG. 7 shows the underside of the flexible wedges, in accordance with an exemplary embodiment of the present invention.

FIG. 7 shows an exemplary underside of the flexible wedges, in accordance with an exemplary embodiment of the present invention. Of course, the flexible wedges may be formed from a solid material such as wood, or plywood.

In particular, as shown in FIG. 7, flexible wedges have a lower contacting surface that is not necessarily planar, and not necessarily horizontal.

As shown in FIG. 7, exemplary flexible wedges may be a generally hollow structure with machined or molded ribs, multiple slots, or drilled holes or any hollowing cavities so as to provide light weight to the flexible wedge, and so as to be strong in specific areas. Alternatively, the inventive flexible wedges may be formed from a wood or other solid material. Preferably, the solid material will have suitable flexibility properties. For instance, wood layers glued together (i.e., plywood-like) will provide flexibility to the wedge material, though slots are still preferred and required.

Figure 8:
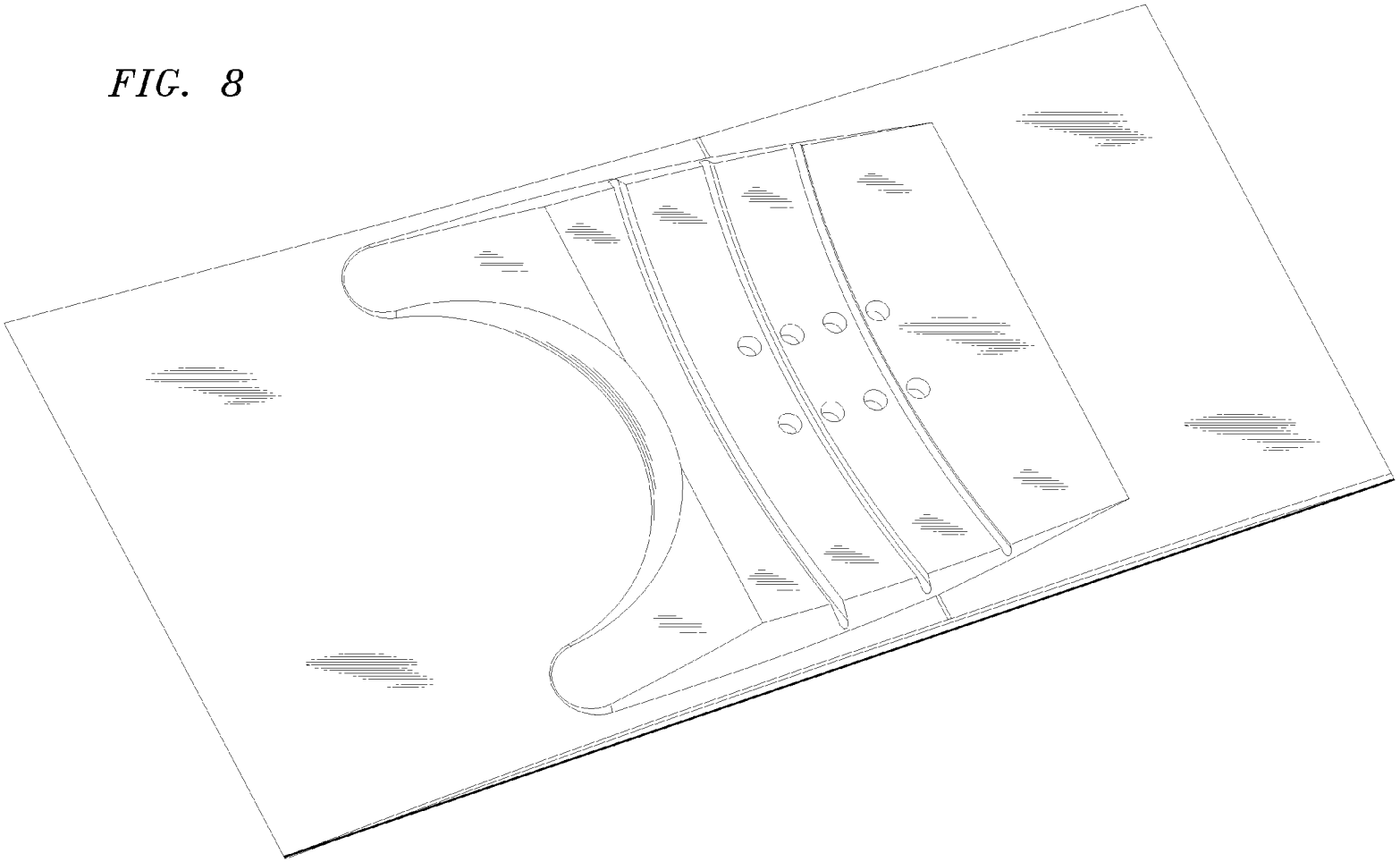
FIG. 8 shows another embodiment of flexible wedges having radial flexion slots, in accordance with the principles of the present invention.

FIG. 8 shows another embodiment of flexible wedges having radial flexion slots, in accordance with the principles of the present invention.

In particular, as shown in FIG. 8 (as well as in FIG. 4A), flexible wedges in accordance with the invention are preferably perpendicular, or almost perpendicular, to the lengthwise axis of the sportsboard (snowboard).

FIG. 8 shows that flexible wedges can be screwed in/on or glued to the reinforced and or finished surface of a snowboard, regardless the shape of surface (w/pre-treaded holes).

As seen from above, flexible wedges can be of any shape, with or without chamfer angles or filets on contour walls and edges bellow or above etc. Flexible wedges may also have virtually any surface finish.

Figure 9:
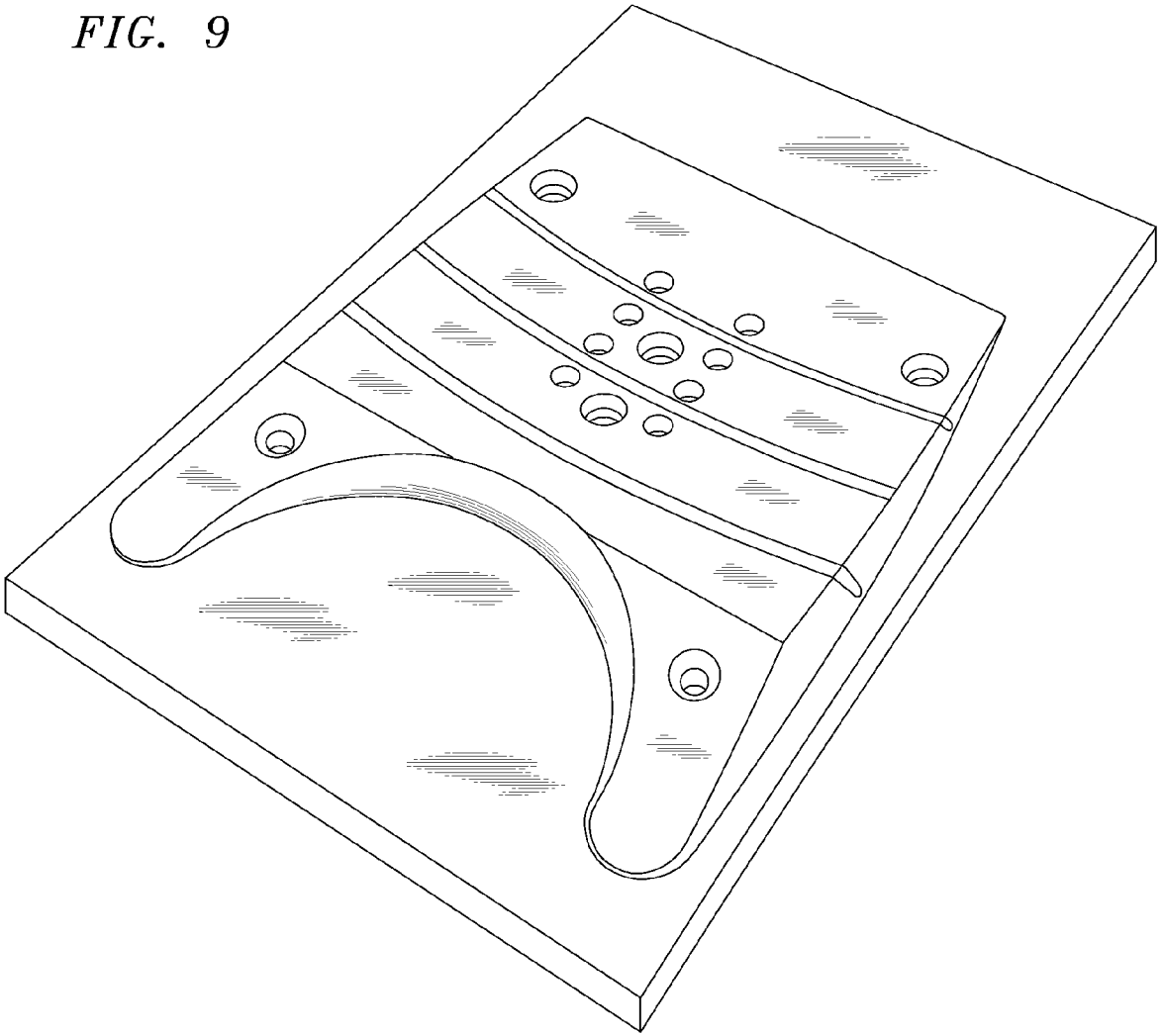
FIG. 9 shows exemplary screwed flexible wedges and protuberances, in accordance with the principles of the present invention.

FIG. 9 shows exemplary screwed flexible wedges and protuberances, in accordance with the principles of the present invention.

In particular, as shown in FIG. 9, flexible wedge contours may be mostly rounded with multiple radiuses, and may also have some other multiple radiuses or any geometric shape protuberances on it's contour mostly at the end of the thicker portion.

Figure 10:
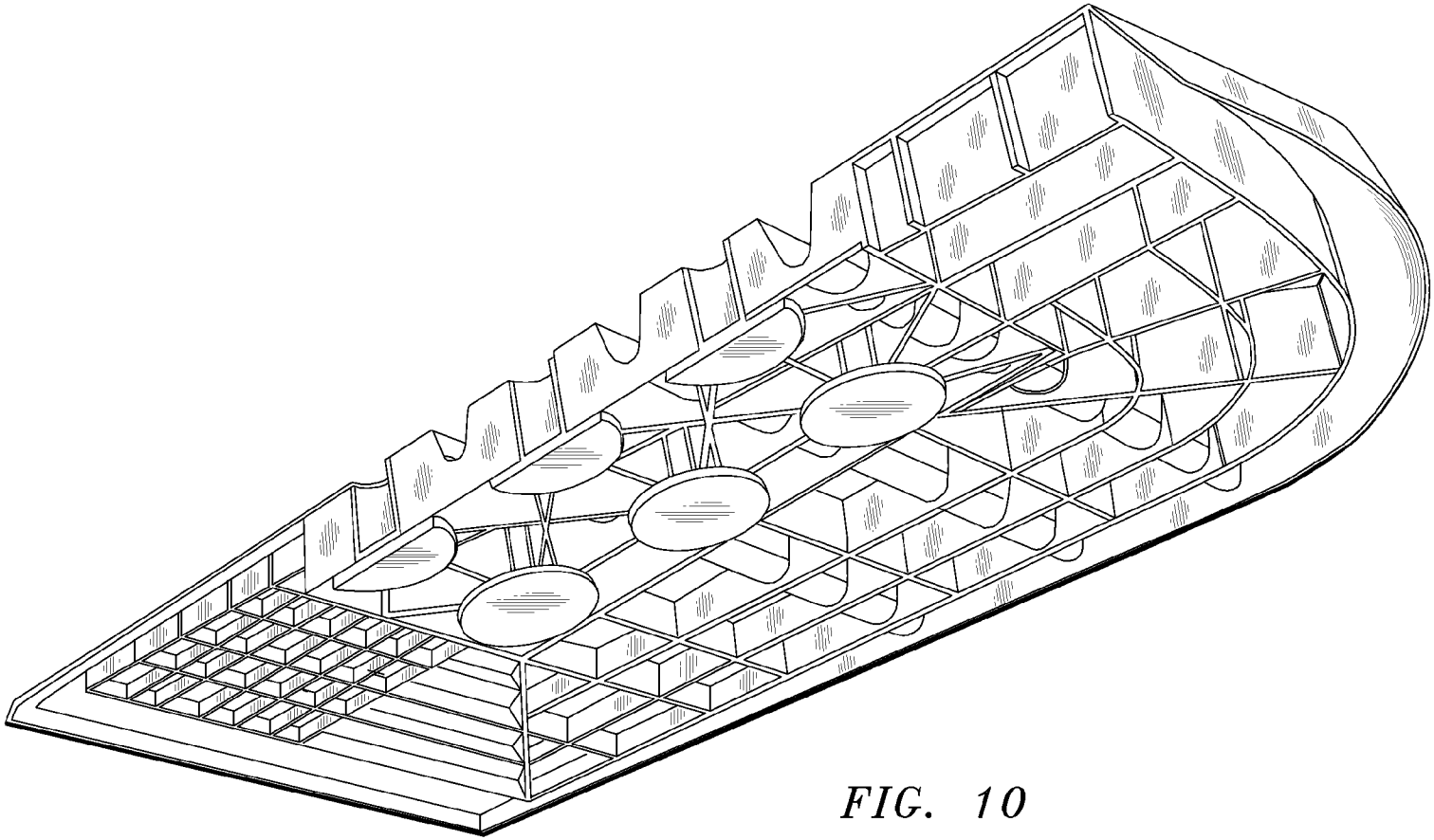
FIG. 10 is a cross cut view showing inserts in exemplary flexible wedges, in accordance with the principles of the present invention.

FIG. 10 is a cross cut view showing inserts in exemplary flexible wedges, in accordance with the principles of the present invention.

In particular, as shown in FIG. 10, the centered portion below an exemplary flexible wedge may exceed the perimeter of a main body of the flexible wedge. The flexible wedge may have long threaded "T" inserts inserted via the lower surface of the flexible wedge and inserted in parallel to the upper surface of the flexible wedge, to provide adherence to the main core body.

Figure 10B:
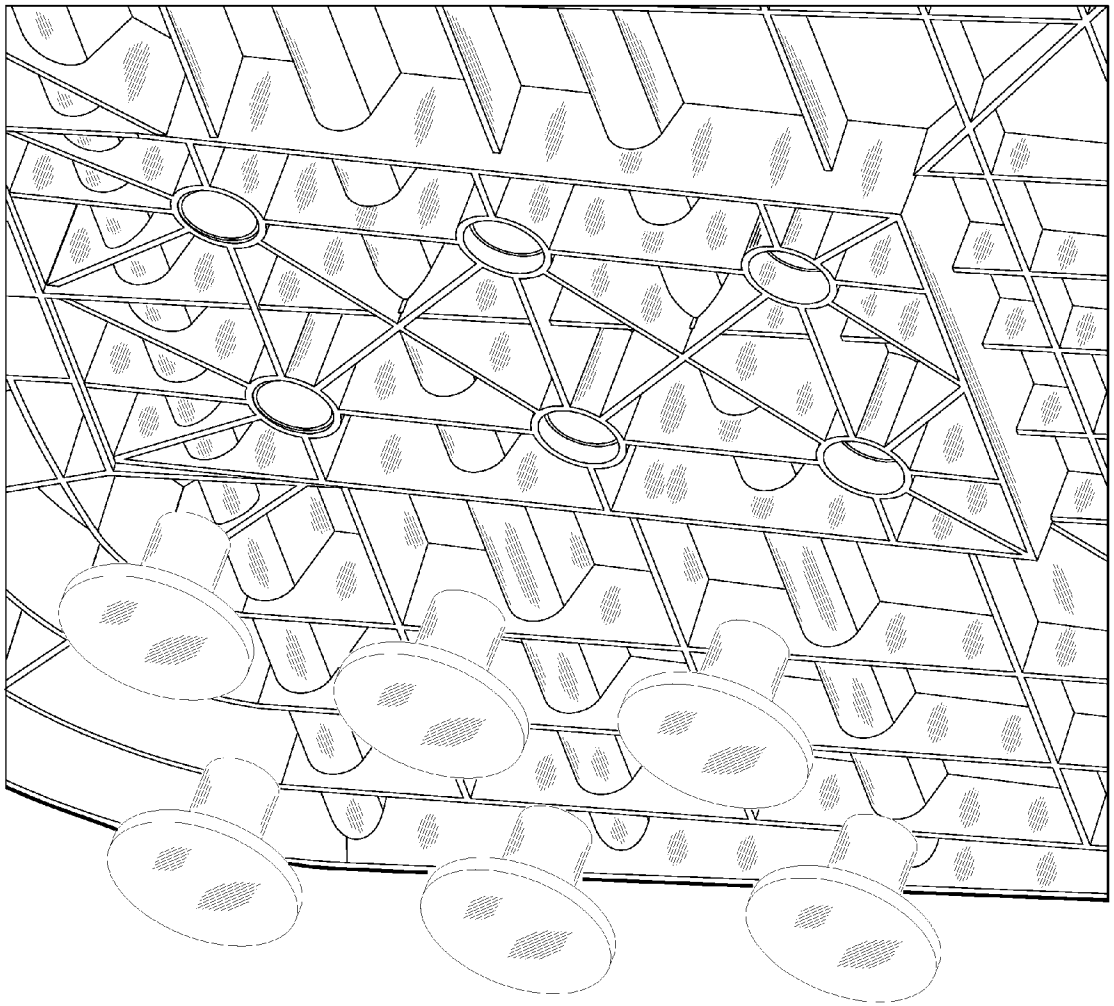
FIG. 10B shows inserts below a flexible wedge, in accordance with the principles of the present invention.

FIG. 10B shows inserts below a flexible wedge, in accordance with the principles of the present invention.

Figure 10C:
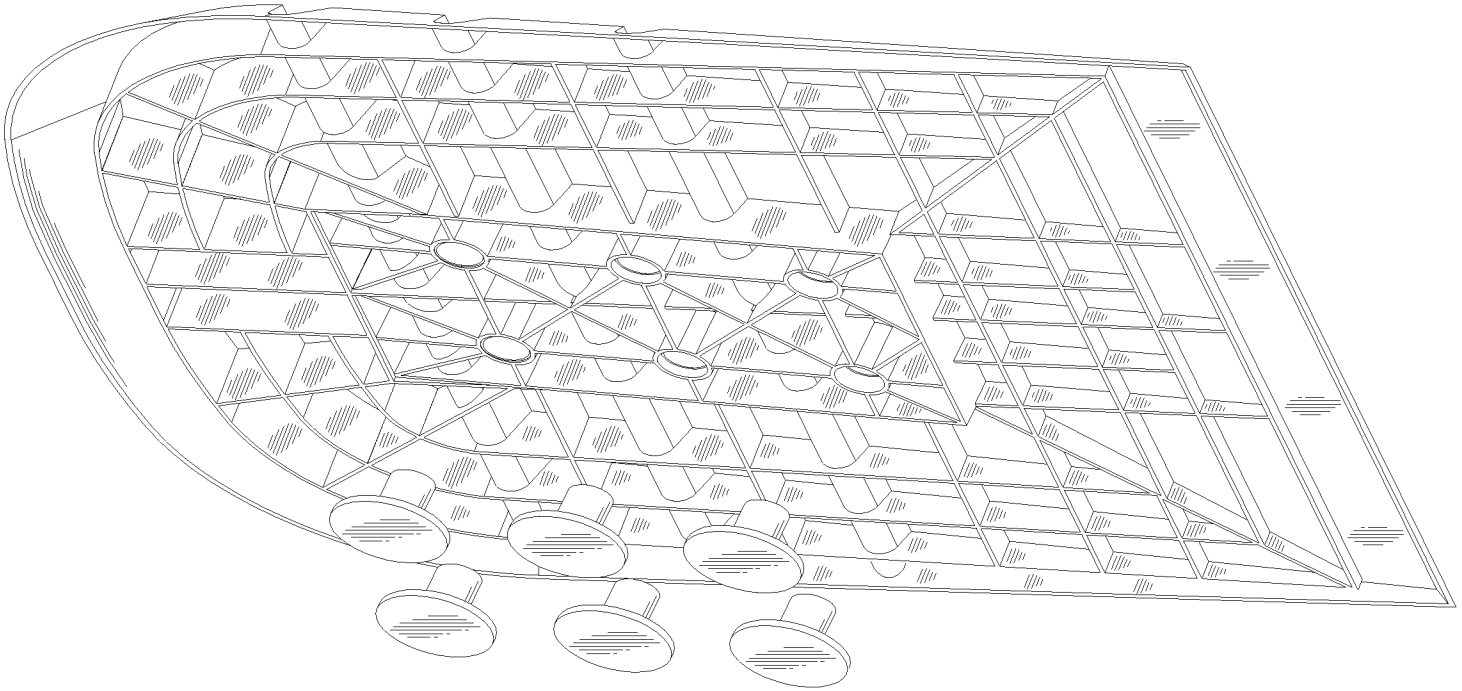
FIG. 10C is an exploded view showing inserts in a flexible wedge, in accordance with the principles of the present invention.

FIG. 10C is an exploded view showing inserts in a flexible wedge, in accordance with the principles of the present invention.

Figure 11B:
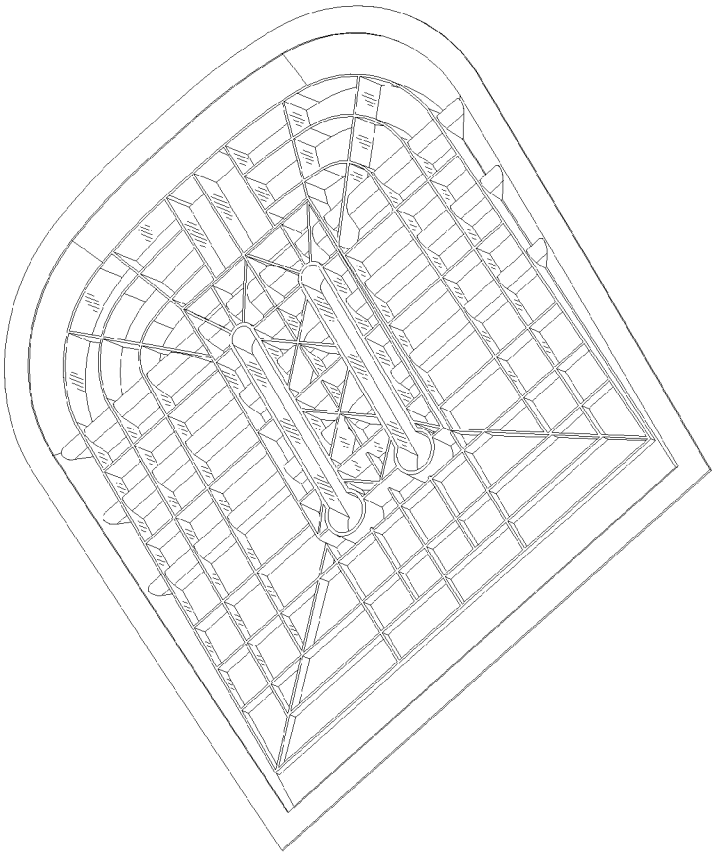
FIGS. 11A and 11B show exemplary flexible wedges with slots, in accordance with the principles of the present invention.
Figure 11A:
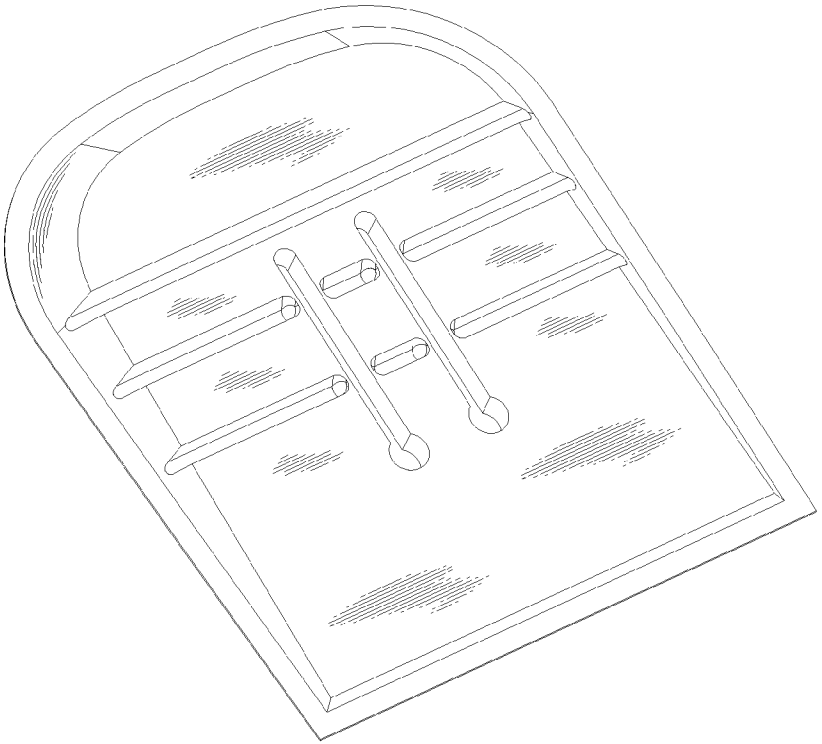

FIGS. 11A and 11B show exemplary flexible wedges with slots, in accordance with the principles of the present invention.

In particular, as shown in FIGS. 11A and 11B, the flexible wedge can include axial slots to allow T-inserts to move freely providing micro adjustment of the T-inserts. This accommodates variations in binding mounts. There may be one axial slot for this purpose, or many. The axial slots may be long, or short. They may be parallel, or not along the lengthwise axis of the snowboard.

Moreover, as shown in FIGS. 11A and 11B, to provide attachment of the miscellaneous binding systems to the finished snowboard, cavities created by the axial slots are preferably always perpendicular to the top surface of the flexible wedge, even if other reinforcement or surface material does cover the flexible wedge.

Figure 12B:
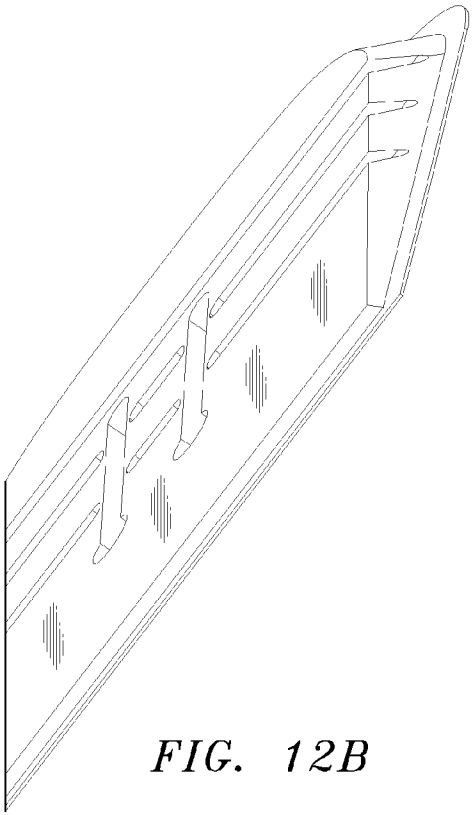
FIGS. 12A and 12B show another embodiment of a formed flexible wedge showing an edge portion exceeding the perimeter of the flexible wedge, in accordance with the principles of the present invention.
Figure 12A:
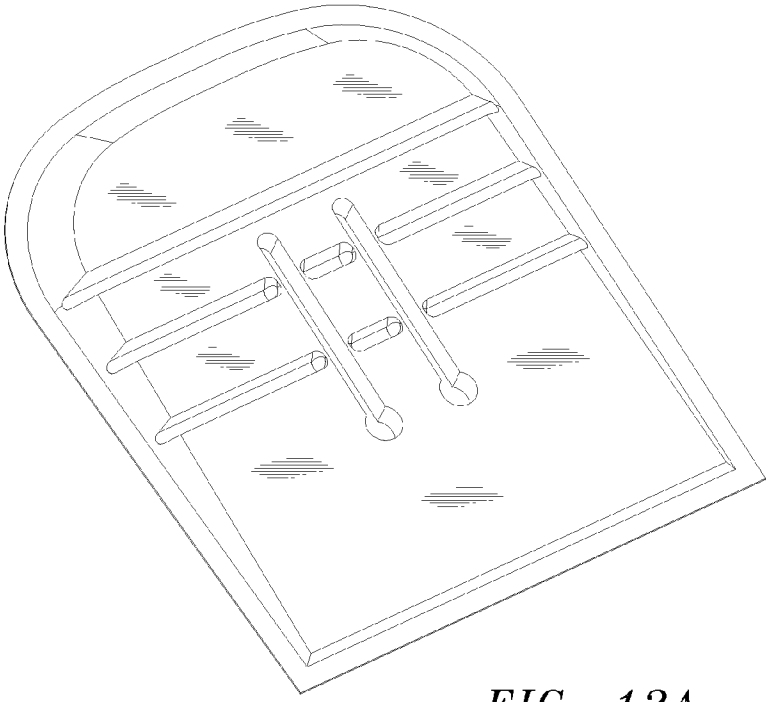

FIGS. 12A and 12B show another embodiment of a formed flexible wedge showing an edge portion exceeding the perimeter of the flexible wedge, in accordance with the principles of the present invention.

In particular, FIGS. 12A and 12B show that the flexible wedge can have an exceeding lower portion surface extrapolating toward the outside of its perimeter to allow for added contact to the main core body.

Figure 13:
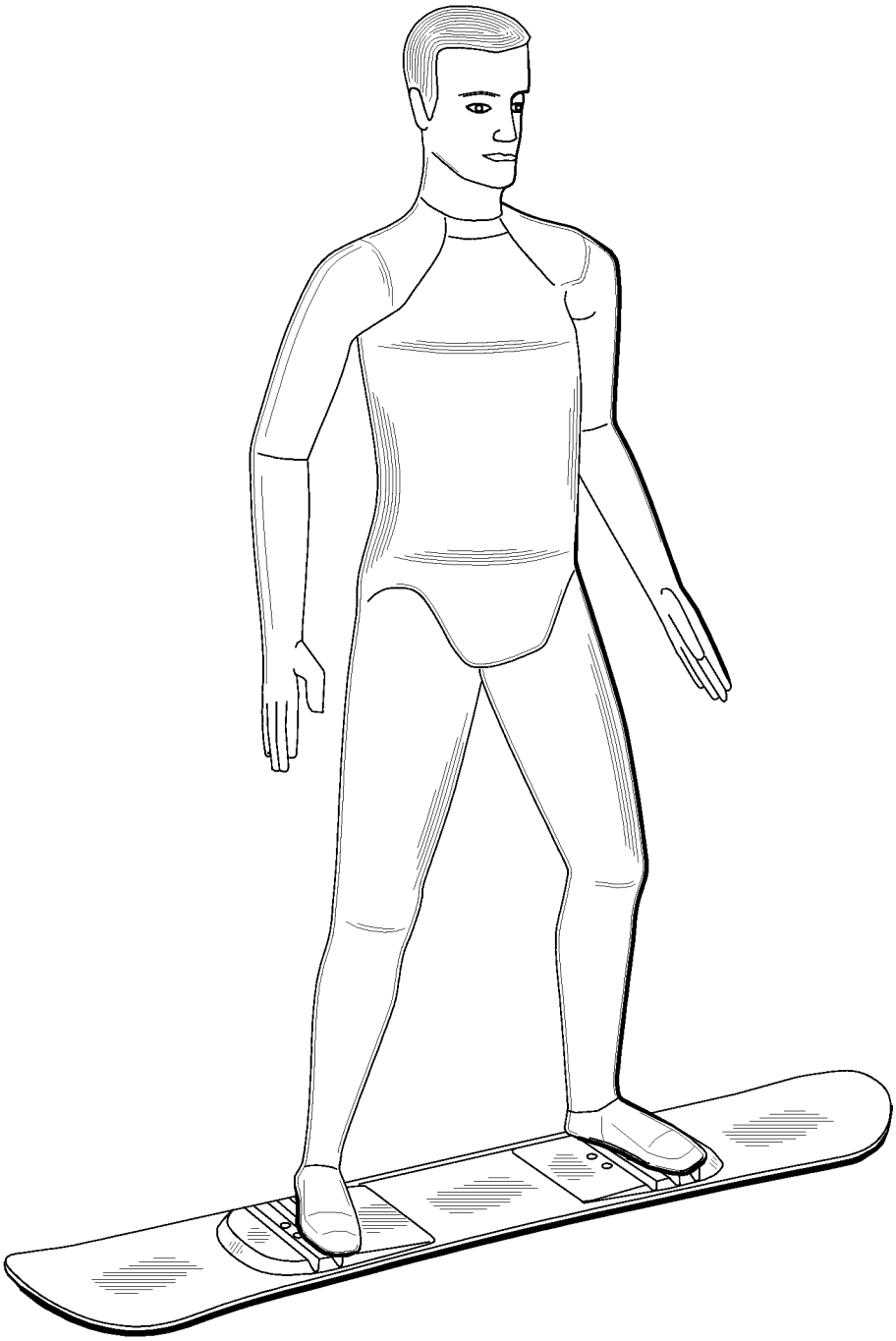
FIG. 13 shows a rider on an ergonomic snowboard including flexible wedges, in accordance with the principles of the present invention.

FIG. 13 shows a rider on an ergonomic snowboard including flexible wedges, in accordance with the principles of the present invention.

In particular, as shown in FIG. 13, the flexible wedges are preferably located directly on the main core body, or on the finished snowboard, at the very stance of a snowboarder according to it's anthropometry for best postural positioning of the rider.

Figure 14A:
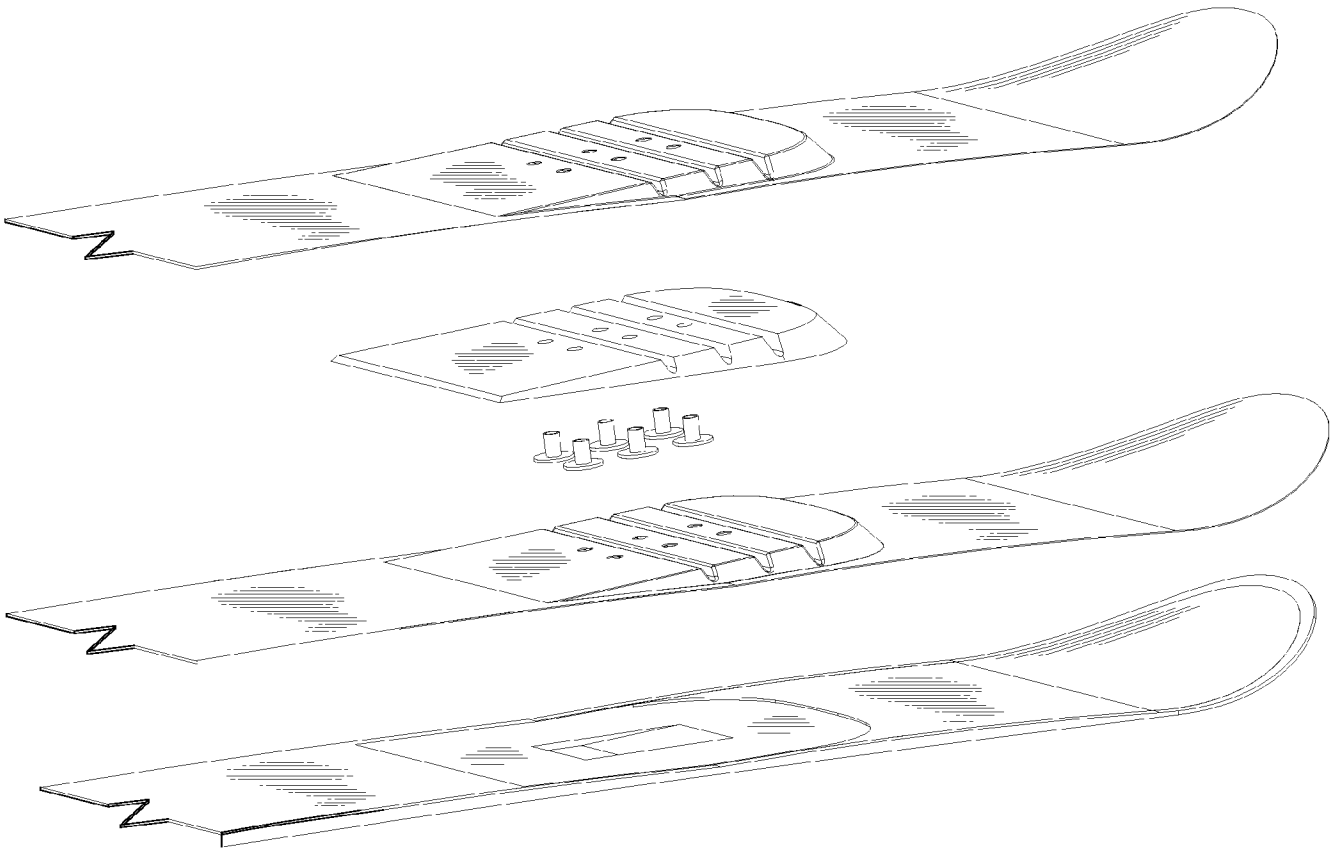
FIG. 14A is an exploded view showing reinforced flexible wedges with reinforced top, in accordance with the principles of the present invention.

FIG. 14A is an exploded view showing reinforced flexible wedges with reinforced top, in accordance with the principles of the present invention.

In particular, as shown in FIG. 14A, the core can have an added mean of reinforcement between the wedges and the core receiving cavity.

Figure 14B:
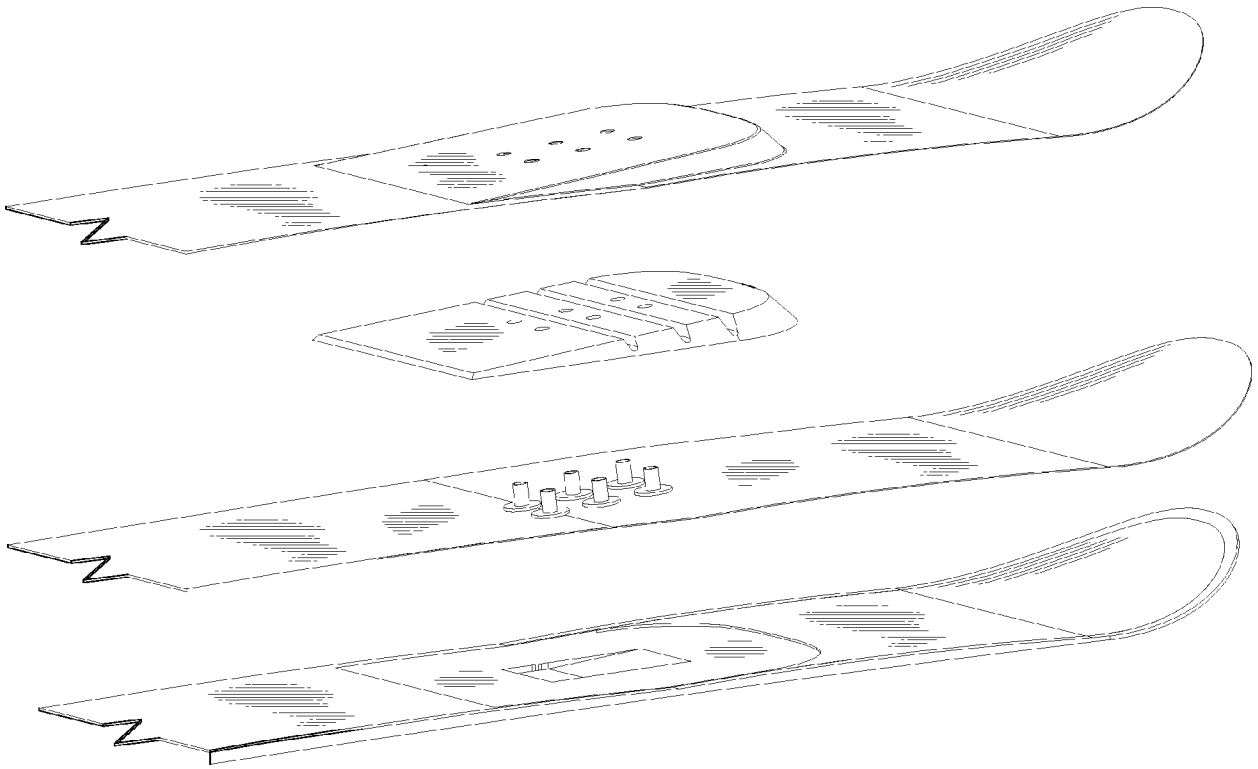
FIG. 14B is an exploded view of another embodiment showing reinforced flexible wedges with reinforced top, in accordance with the principles of the present invention.

FIG. 14B is an exploded view of another embodiment showing reinforced flexible wedges with reinforced top, in accordance with the principles of the present invention.

In particular, as shown in FIG. 14B, an otherwise conventionally known reinforcement is implemented above the completed wedge and main core body assembly, the reinforcement going above and around the wedge, and also rests on the otherwise conventional reinforcement or is in direct contact with the main core body.

Figure 15A:
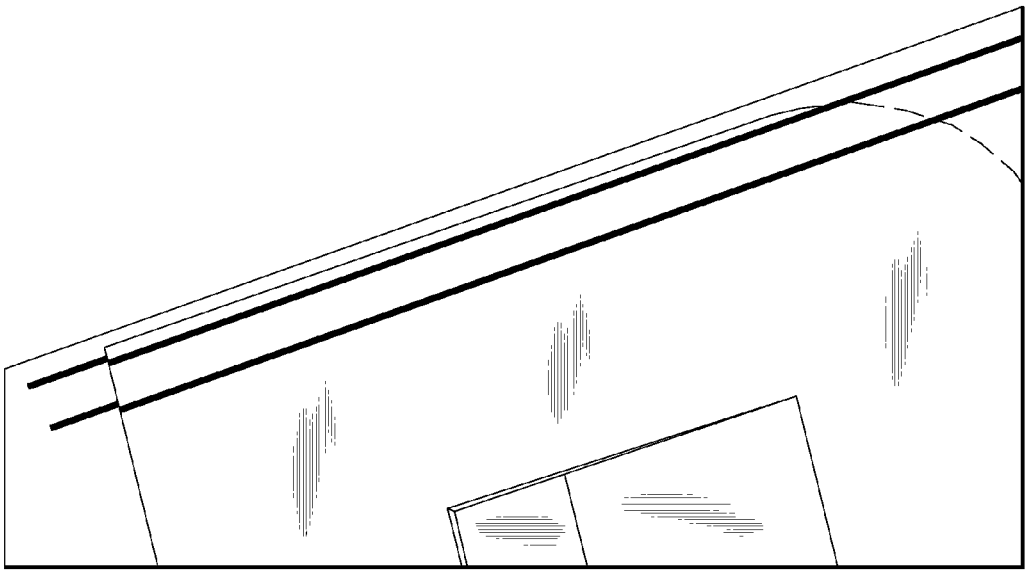
FIGS. 15A and 15B show through core side slots and reinforcement of exemplary flexible wedges, in accordance with the principles of the present invention.
Figure 15B:
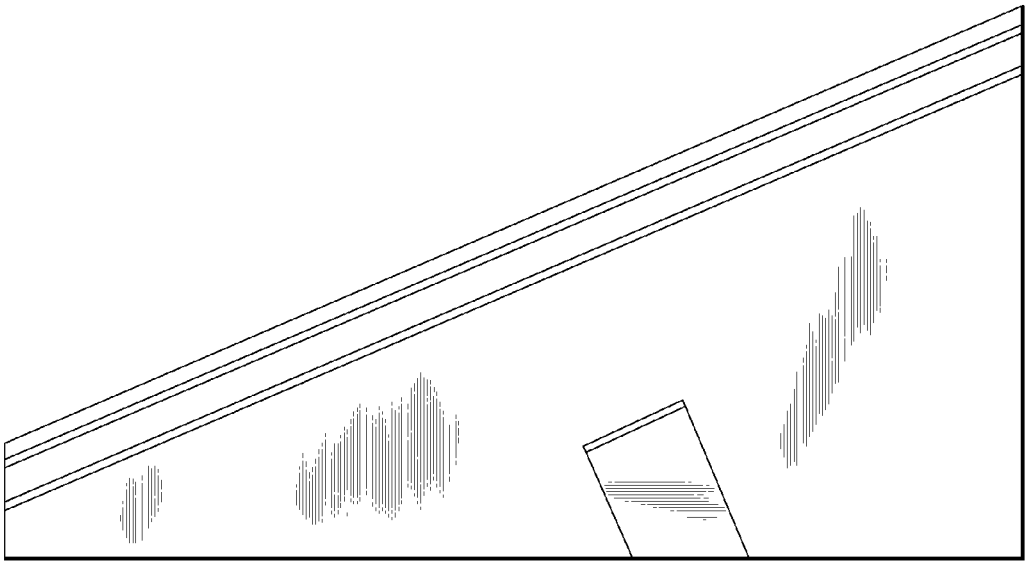

FIGS. 15A and 15B show through core side slots and reinforcement of exemplary flexible wedges, in accordance with the principles of the present invention.

In particular, as shown in FIGS. 15A and 15B, to facilitate a light weight flexible wedge and overall sportsboard, the overall lower core surface can also include a hollow structure, machined or molded ribs, or multiple slots or drilled holes, or any hollowing cavities.

The main core body can have slots or an orifice through it from the upper surface to the lower surface, the slot(s) being filled with a shear or impact resistant material to avoid undesired flexible wedge penetration into the main core body.

The flexion slots can be of any shape and dimensions and are located about the location of the wedges close to the perimeter of the main core body.

In FIGS. 15A and 15B, otherwise conventionally known reinforcement is inserted in the main core body traversing slots at the location of the wedges (to avoid wedge penetration into the main core body, following harsh riding impact).

Figure 16:
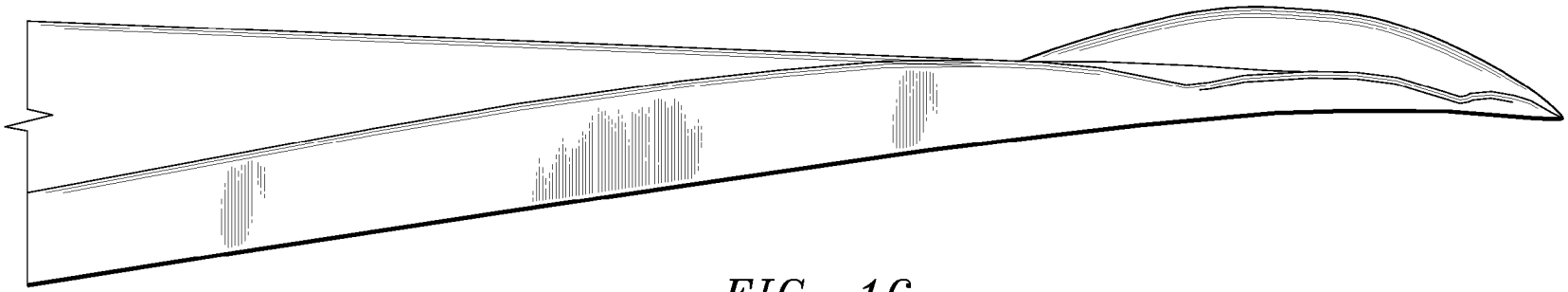
FIG. 16 shows an exemplary core depression, in accordance with the principles of the present invention.

FIG. 16 shows an exemplary core depression, in accordance with the principles of the present invention.

In particular, as shown in FIG. 16, the upper surface of the main core body can be of any shape, most particularly composed of four main depressions in thickness, two at the approximate location of the middle area of the flexible wedges, and two for both ends. In the exemplary embodiment, in a direction running from one axial end of a snowboard to the other, the core depression is thin at one end, thicker toward and close to the front of the flexible wedge, thin toward the middle of the first flexible wedge, thicker toward the middle of the main core body, thinner toward and about at the middle of the other flexible wedge, thicker past the flexible wedge, then thinner toward the other far end of the main core body.

Figure 17:
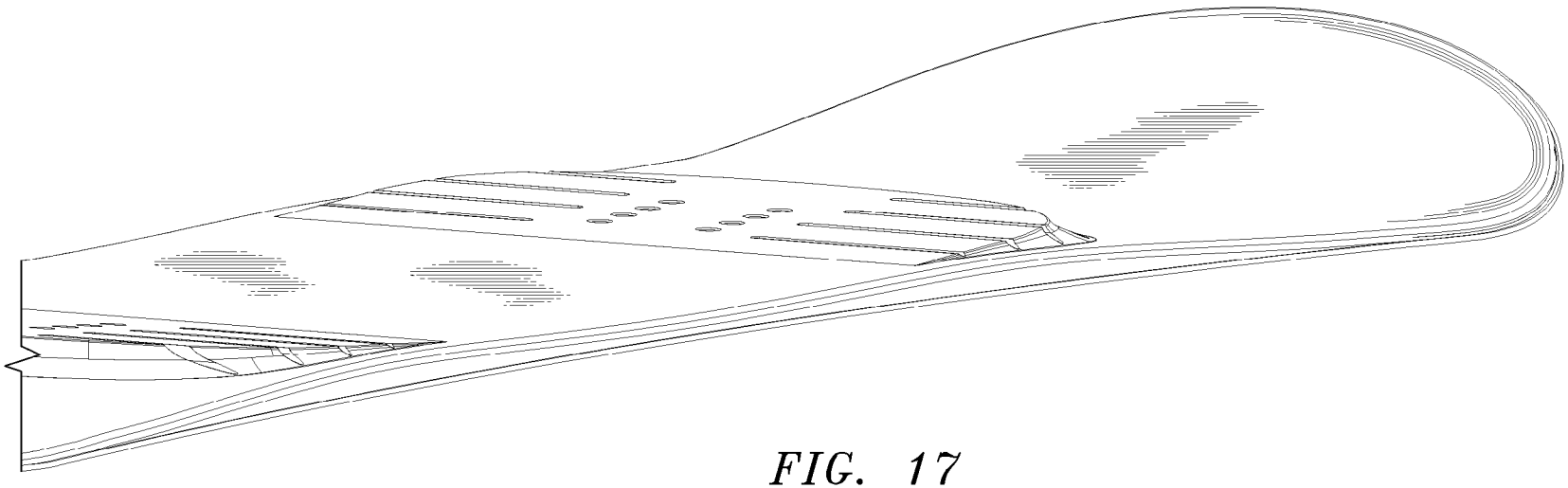
FIG. 17 is a profile view showing triple bumps formed in the core of a snowboard including flexible wedges, in accordance with the principles of the present invention.

FIG. 17 is a profile view showing triple bumps formed in the core of a snowboard including flexible wedges, in accordance with the principles of the present invention.

In particular, as shown in FIG. 17, the same variation in thickness' purpose is to send compression forces from a thicker portion of the main core body to the middle of the flexible wedges.

Figure 17A:
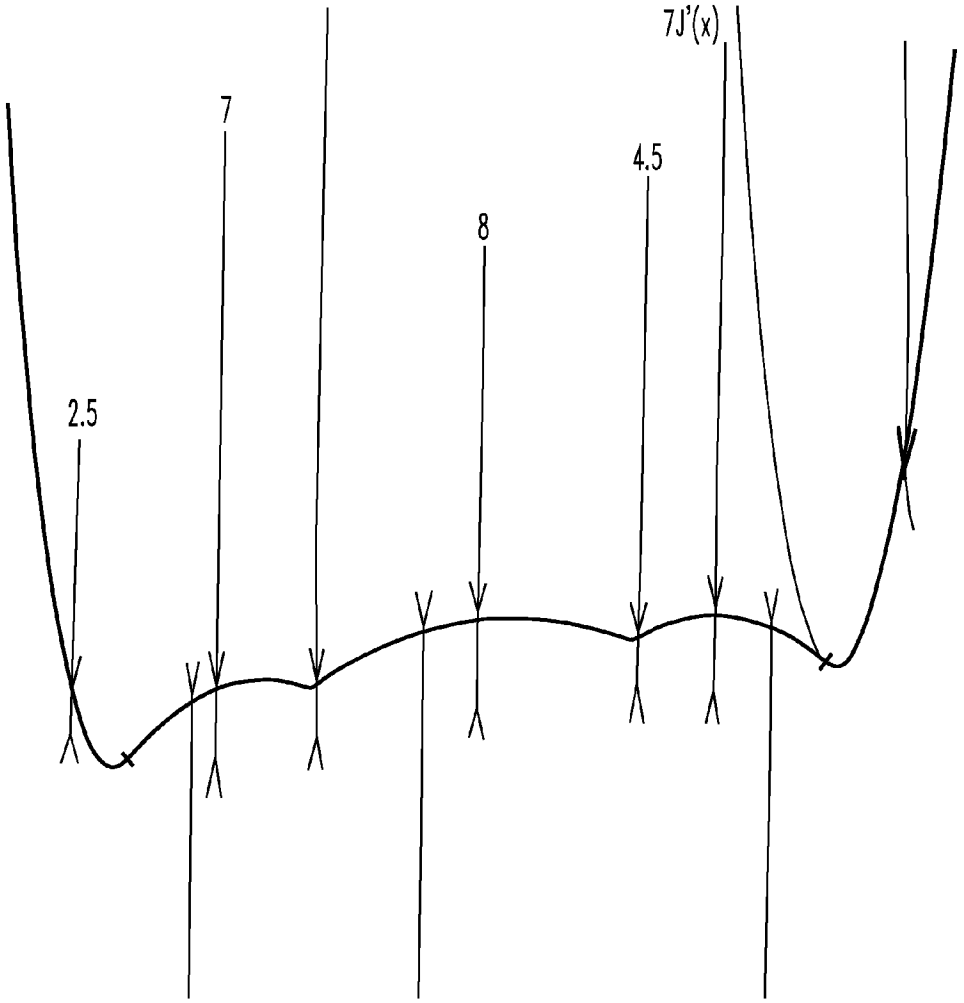
FIG. 17A is a sketch showing a main core body upper surface.

FIG. 17A is a sketch showing a main core body upper surface.

Figure 17B:
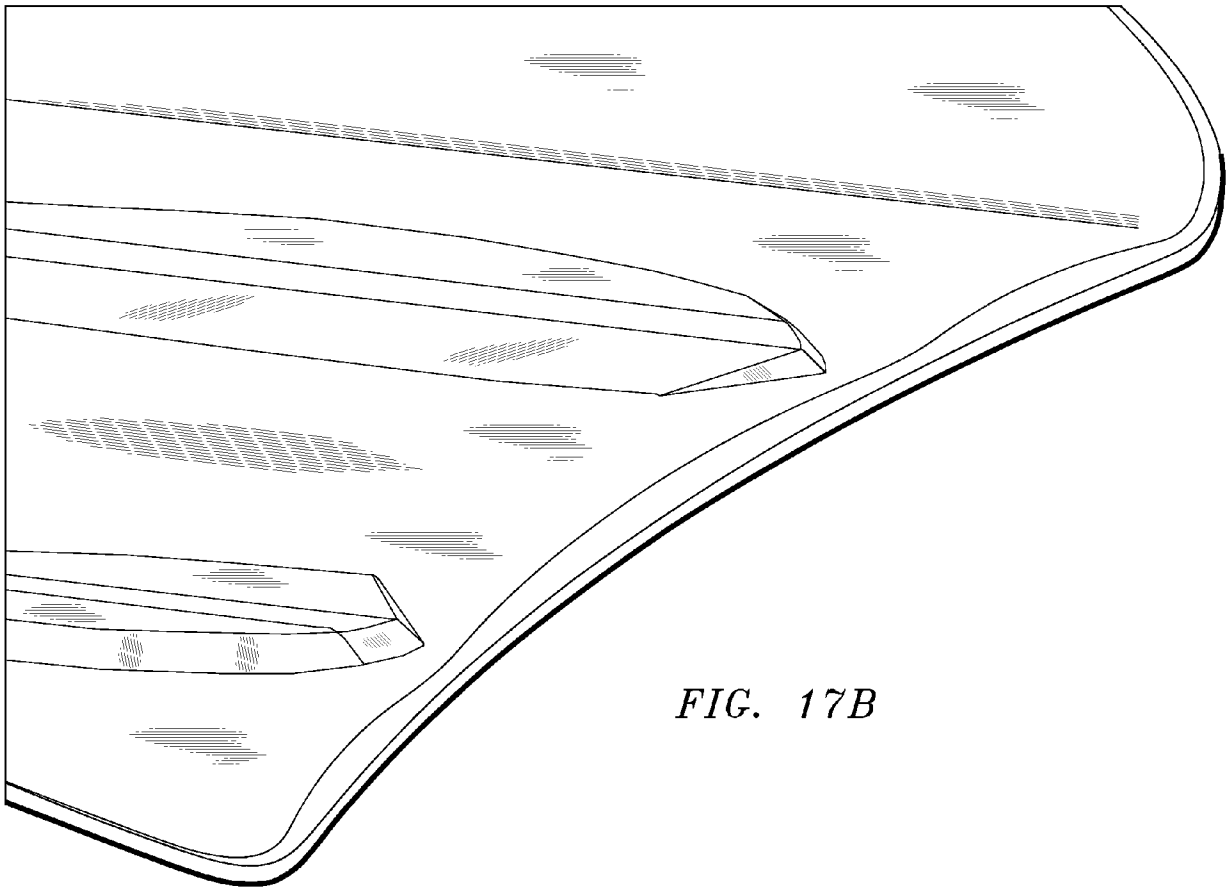
FIG. 17B is a side view showing a quadpattern, in accordance with an embodiment of the present invention.

FIG. 17B is a side view showing a quadpattern, in accordance with an embodiment of the present invention.

In particular, as shown in FIGS. 17A and 17B, the upper variation in thickness is made from machined or molded surface curvature that are preferably all tangent, to avoid deflexion irregularities and or breakage of the body once merged with the flexible wedges.

Figure 18:
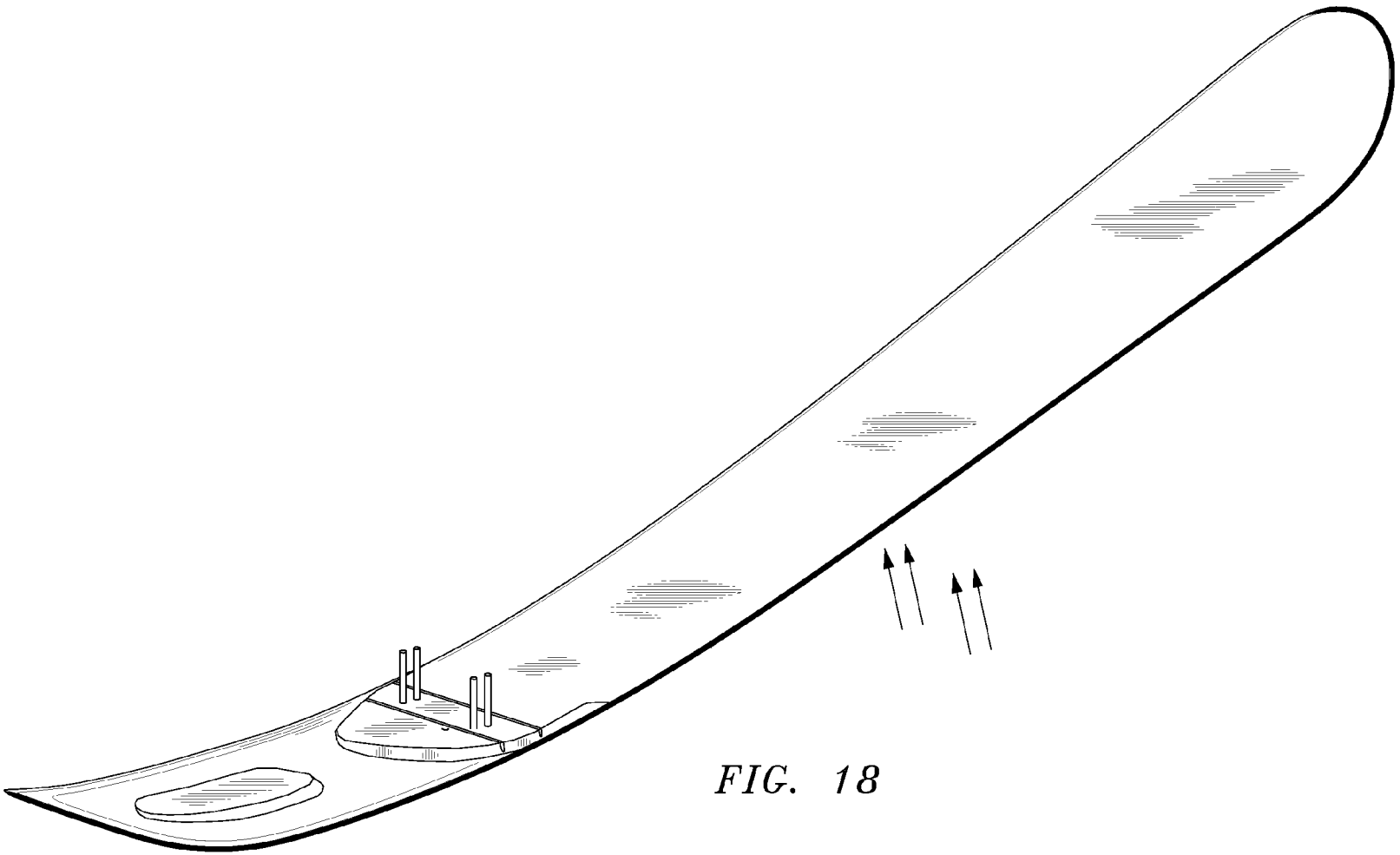
FIG. 18 depicts flexion zones, in accordance with the principles of the present invention.

FIG. 18 depicts flexion zones, in accordance with the principles of the present invention.

In particular, as shown in FIG. 18, the same variation in thickness' purpose is to enable the main core body to have a plurality of controlled flexion and torsion zones.

Figure 19:
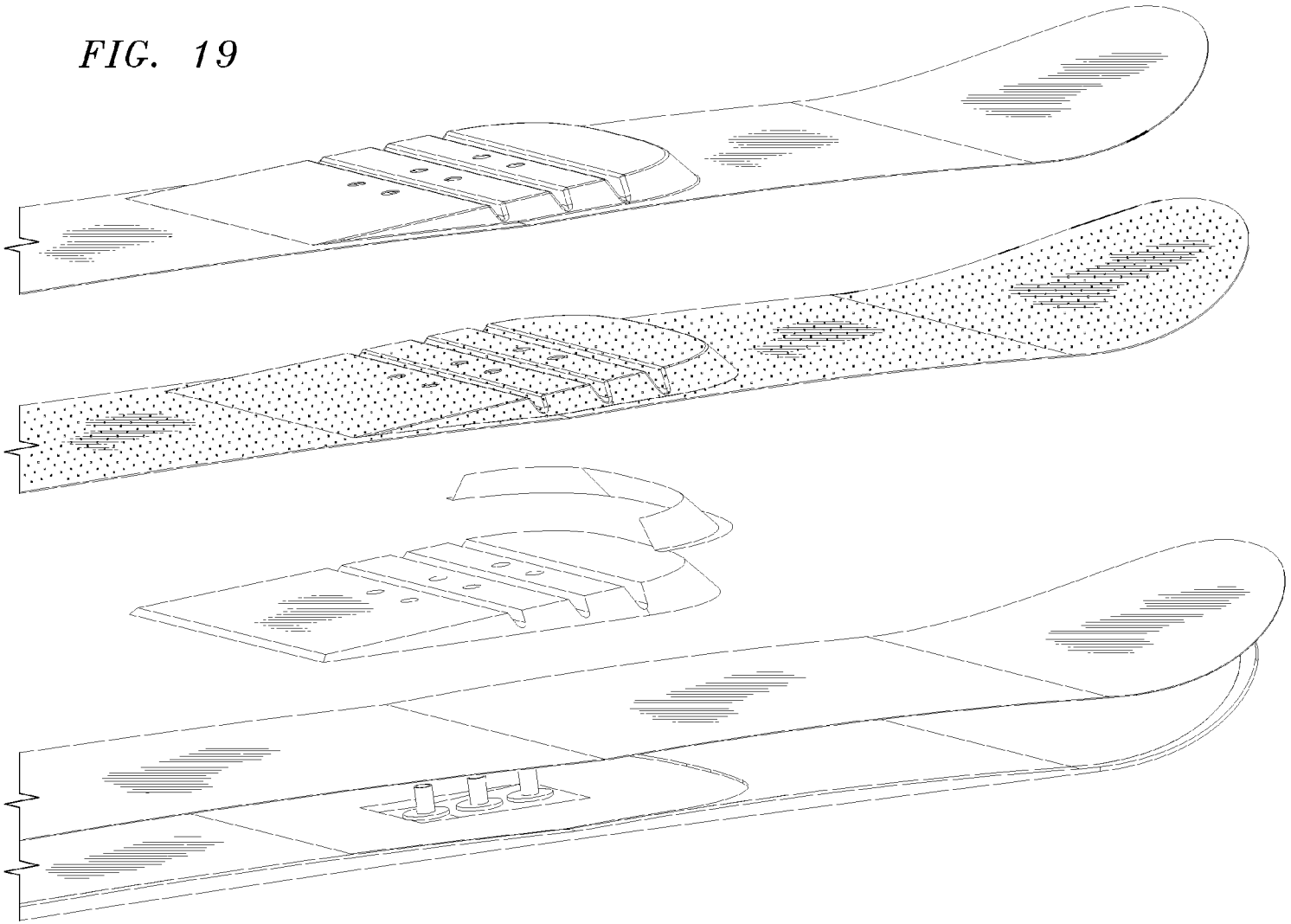
FIG. 19 shows reinforcement strips at an end of an exemplary flexible wedge, in accordance with the principles of the present invention.

FIG. 19 shows reinforcement strips at an end of an exemplary flexible wedge, in accordance with the principles of the present invention.

In particular, as shown in FIG. 19, otherwise conventionally known reinforcement is implemented under the form of strips, above and around the lower edge of the wedges perimeter and up the contouring wedge' outside contour walls.

Figure 20:
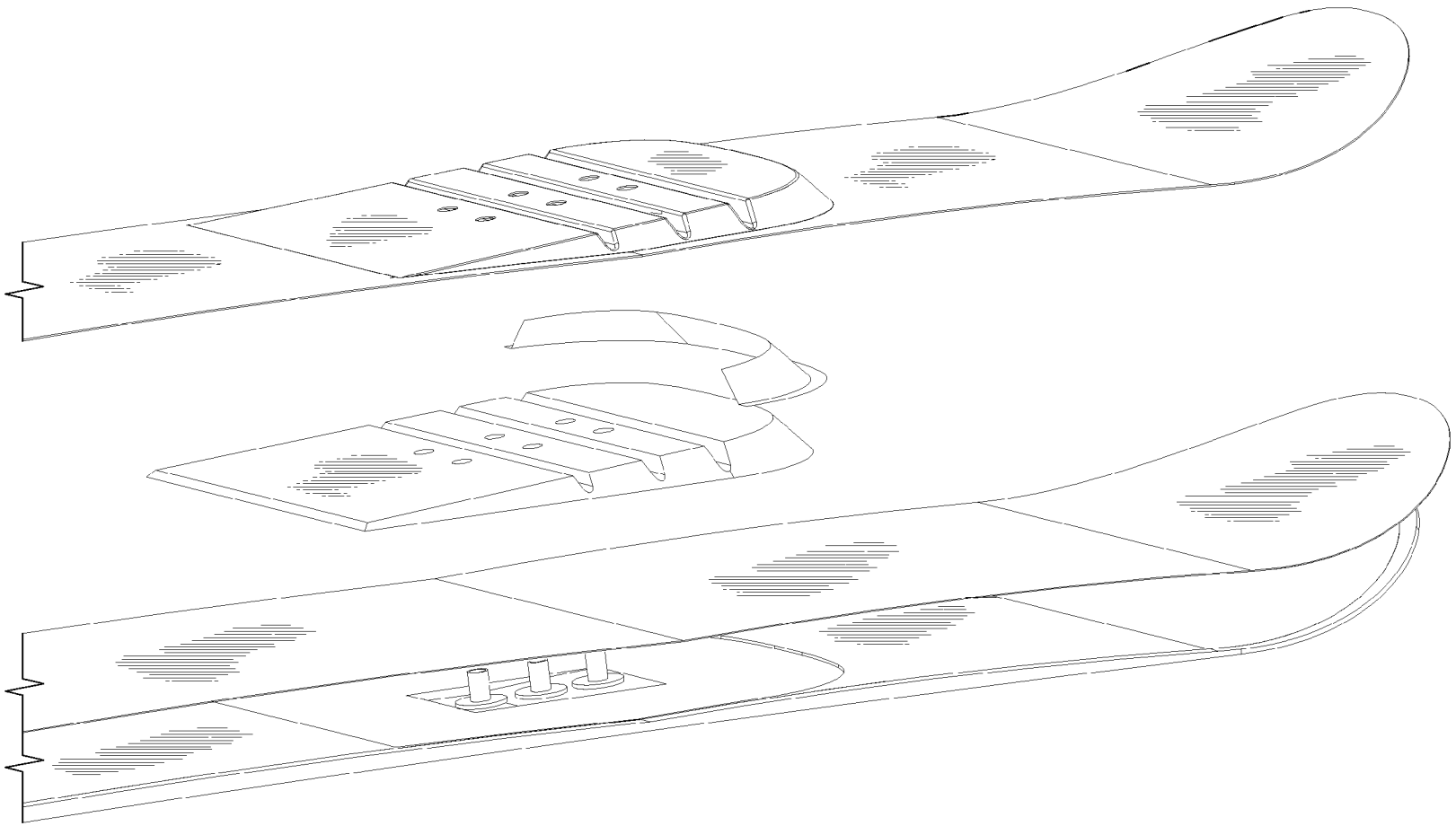
FIG. 20 shows reinforcement strips at wedge and top sheet, in accordance with the principles of the present invention.

FIG. 20 shows reinforcement strips at wedge and top sheet, in accordance with the principles of the present invention.

In particular, as shown in FIG. 20, otherwise conventionally known reinforcement is implemented under the formed strips above and in contact with the lower edge of the wedges at the bottom of the thickest portion of wedge for use with and when a top sheet is installed directly on wedge (i.e., reinforcement in front of the wedge at the bottom of the thicker portion).

Figure 21:
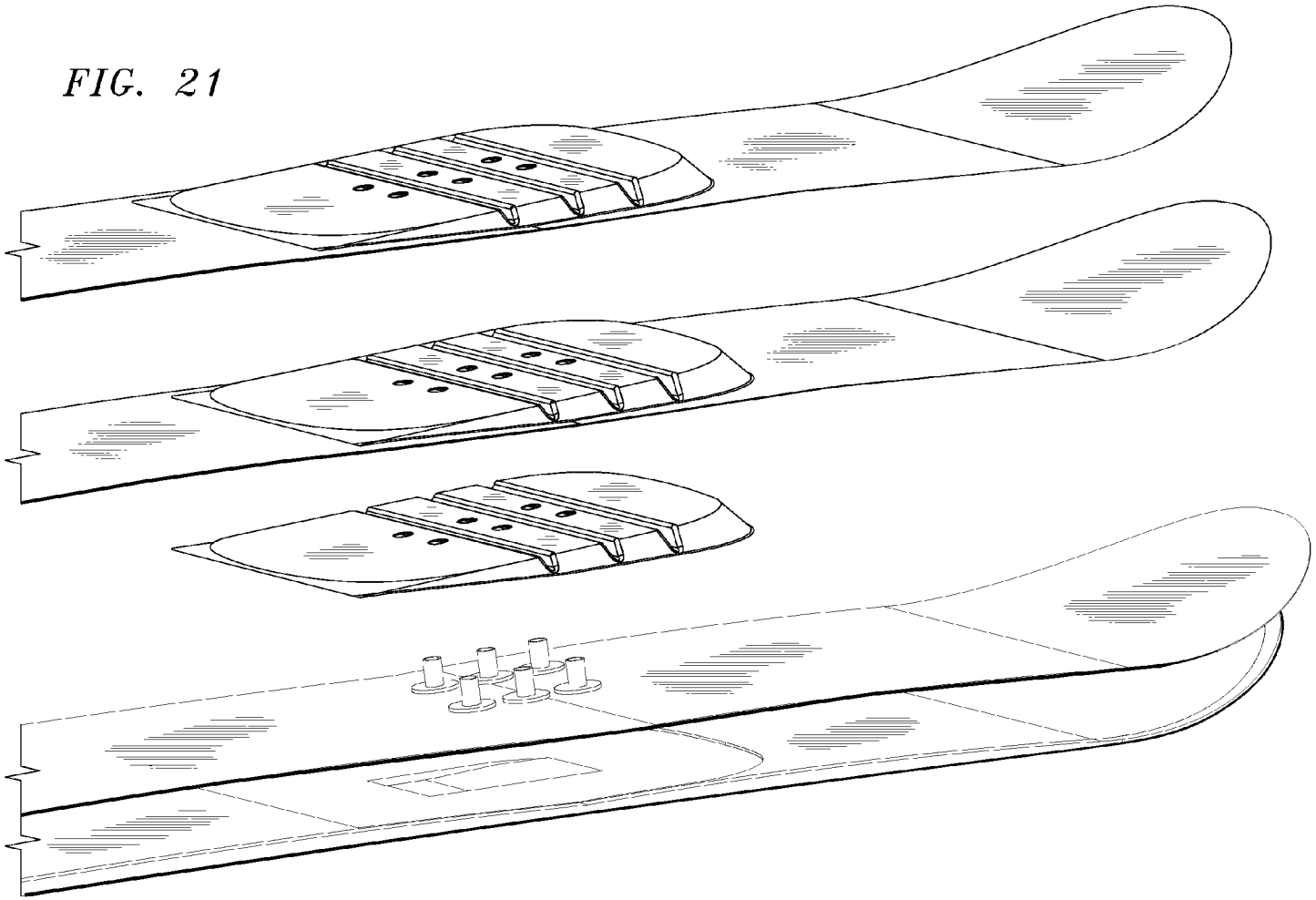
FIG. 21 shows an exploded view of exemplary reinforced flexible wedges with reinforcement, and top core reinforcement layer, in accordance with the principles of the present invention.
Figure 22:
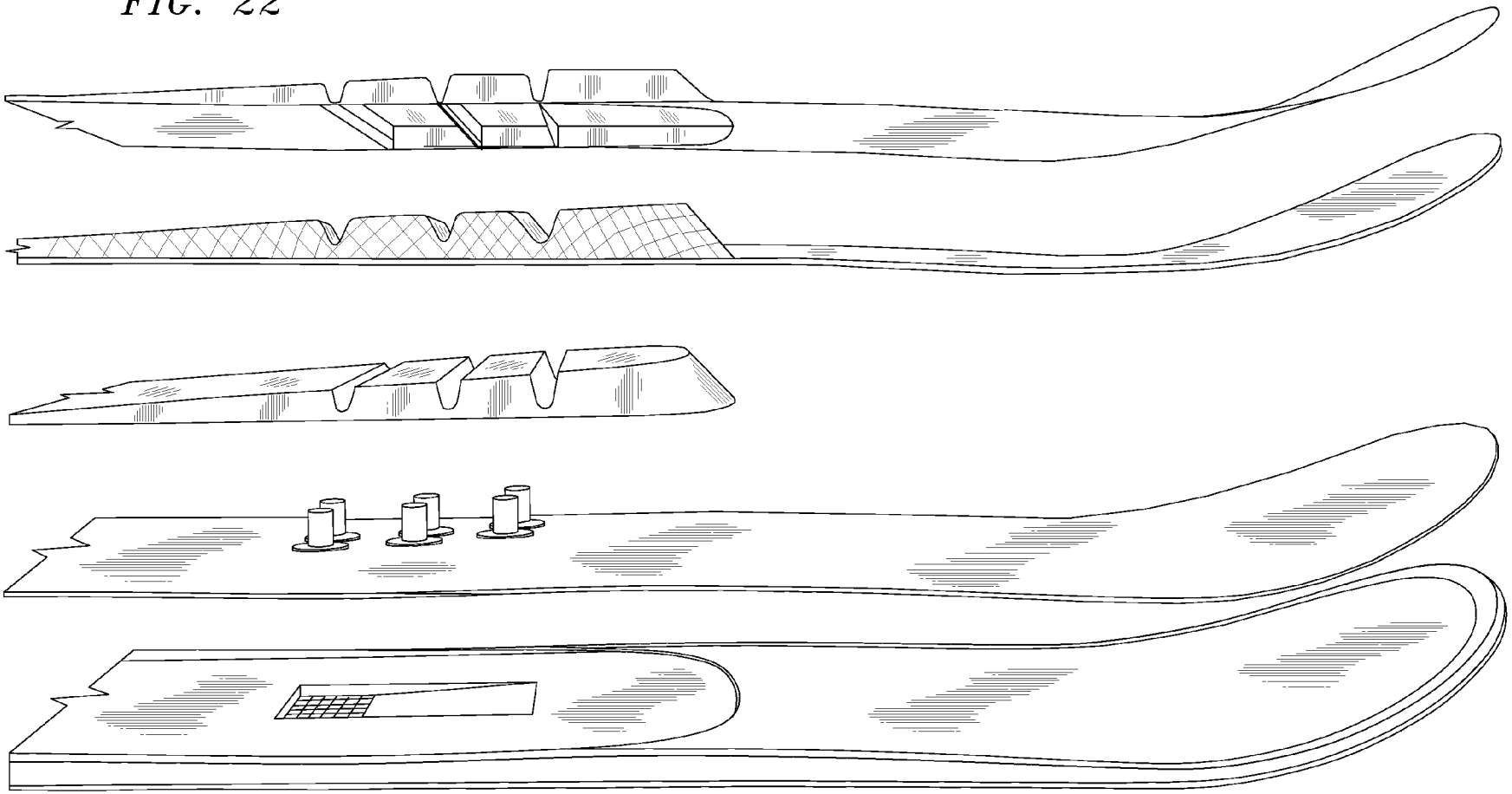
FIG. 22 is another angle showing an exploded view of exemplary reinforced flexible wedges with reinforcement, and top core reinforcement layer, in accordance with the principles of the present invention.

FIGS. 21-22 show embodiments of the flexible wedges including reinforcement layers.

In particular, FIG. 21 shows an exploded view of exemplary reinforced flexible wedges with reinforcement, and top core reinforcement layer, in accordance with the principles of the present invention.

FIG. 22 is another angle showing an exploded view of exemplary reinforced flexible wedges with reinforcement, and top core reinforcement layer, in accordance with the principles of the present invention.

Figure 23:
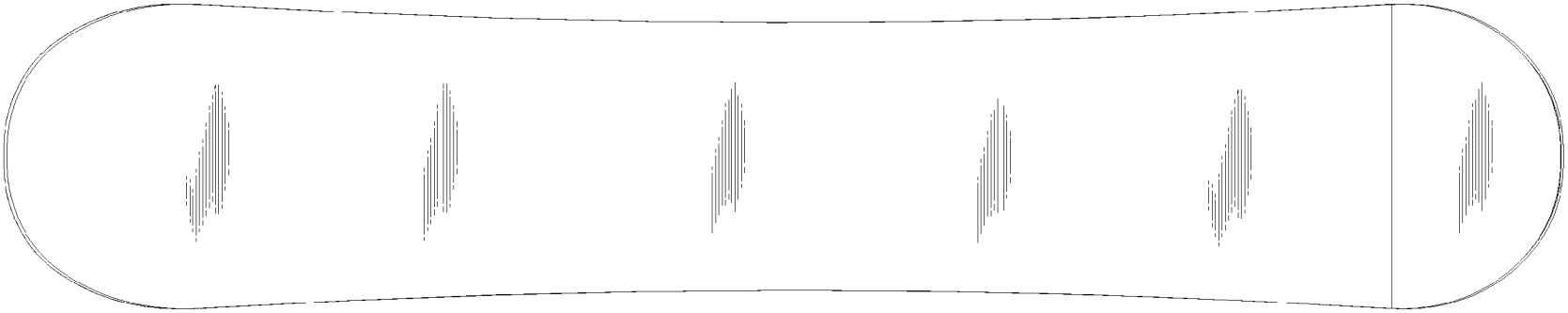
FIG. 23 shows a paralock-mathspline, in accordance with the principles of the present invention.

FIG. 23 shows a paralock-mathspline, in accordance with the principles of the present invention.

Preferably, the ends of the snowboard are mostly of round shape by multiple radiuses. As shown in FIG. 23, one end can be wider than the other one (i.e., having a taper shape). Moreover, the lateral cut or side cut may be made with a besier curve or 3 point mathematic spline (upper left and lower right curves as shown in FIG. 23).

Figure 23A:
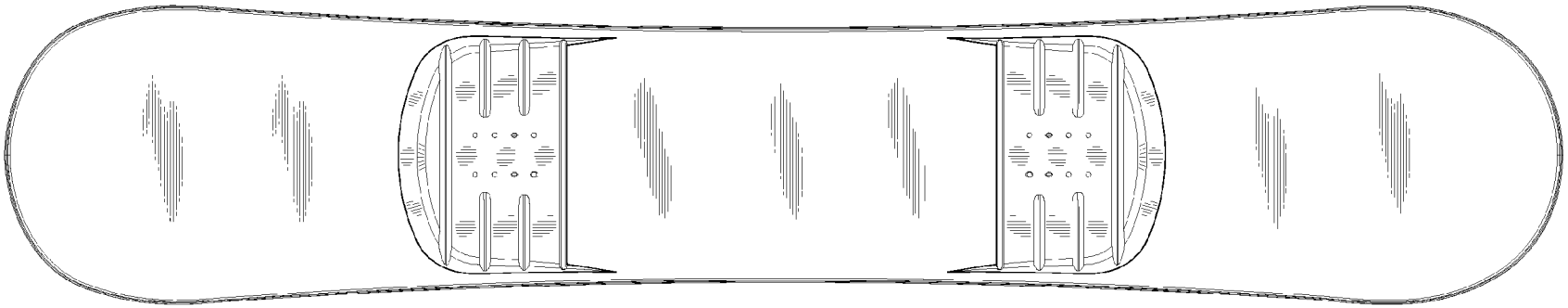
FIG. 23A shows a paralock, in accordance with the principles of the present invention.

As shown in FIG. 23A, in addition to the spline, some ergonomic snowboard models may have a straight line that do start about the middle of the wedge, all the way to about the widest point of the board. This line is always parallel to a similar straight line at the other opposite end, and mirror to the other side.

FIG. 23A shows a paralock, in accordance with the principles of the present invention.

The present invention provides exemplary flex adjustment bushings inserted into slots in wedged area, in accordance with the principles of the present invention. The inventive modern ergonomic snowboard provides the best lower limbs posture and limitless maneuver possibilities. Unique features include a full ergonomic/biomechanic design methodology.

The slotted, flexible wedges in accordance with the present invention provide an adjustable segmented flex.

Preferably flexion slots are formed or otherwise provided in the upper surface of the flexible wedge. As disclosed, the flexion slots in the flexible wedges are preferably made to be linear. The flexion slots may be straight, or may be slightly radial (e.g., with a slot made with a long radius arc or any curved spline instead of a straight perpendicular grooves.) Slots can be with or without chamfer angles or filets on contour walls and edges bellow or above, there can be a discontinuity in the flexion slots.

Figure 24:
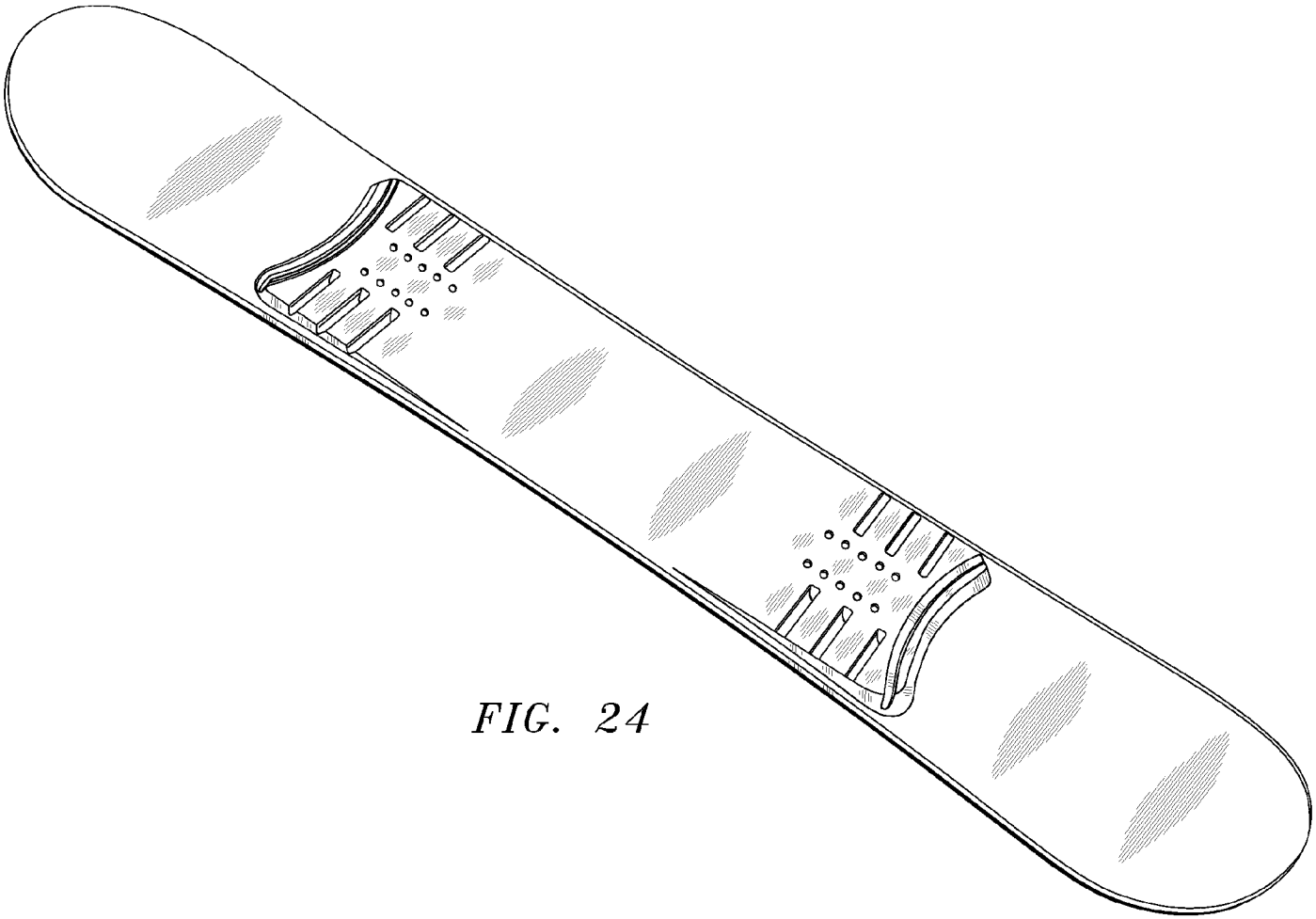
FIG. 24 shows flexible wedges having one arced transverse slot going across binding area, and three sets of slots that are filled in (or actually not formed) in the area substantially directly below the binding area containing the screw inserts, in accordance with the principles of the present invention.

FIG. 24 shows flexible wedges having one arced transverse slot going across binding area, and three sets of slots that are filled in (or actually not formed) in the area substantially directly below the binding area containing the screw inserts, in accordance with the principles of the present invention.

Figure 25:
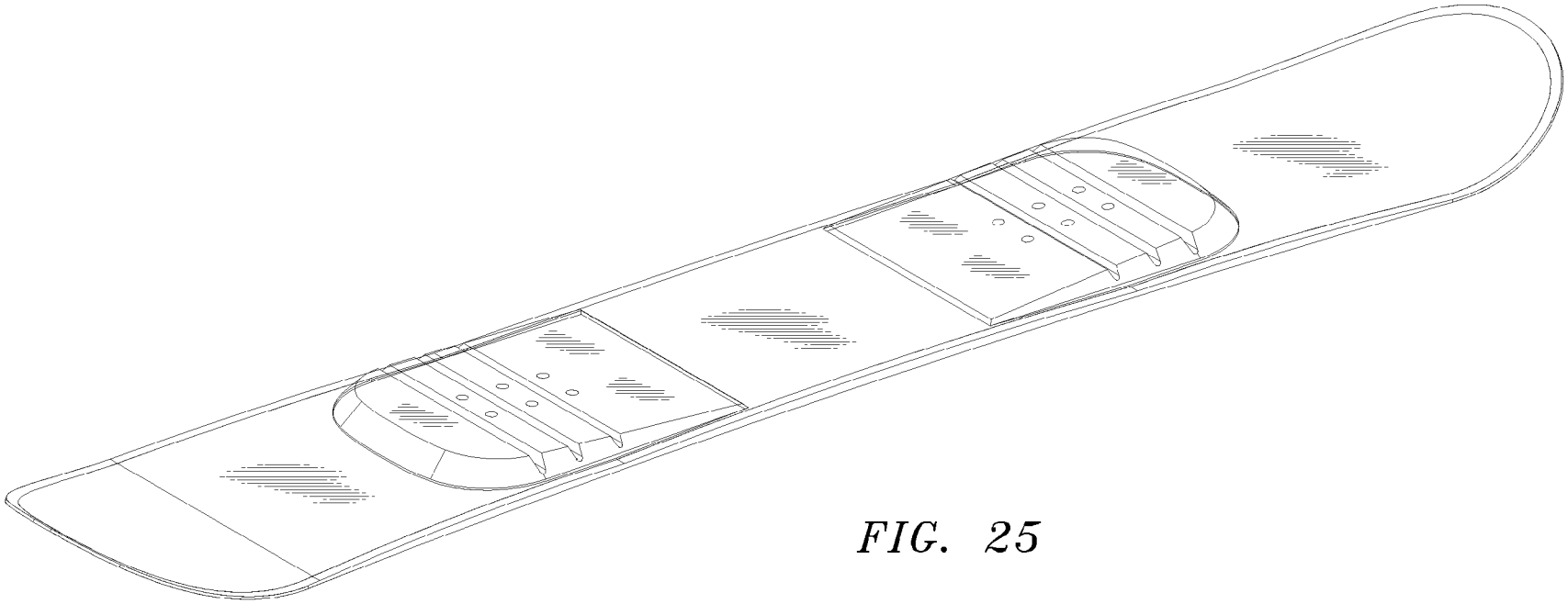
FIG. 25 shows flexible wedges having two transverse slots going across the binding area (one outside and one inside the binding area), as well as two sets of slots that are filled in the area substantially directly below the binding area containing the screw inserts, in accordance with the principles of the present invention.

FIG. 25 shows flexible wedges having two transverse slots going across the binding area (one outside and one inside the binding area), as well as two sets of slots that are filled in the area substantially directly below the binding area containing the screw inserts, in accordance with the principles of the present invention.

Figure 26:
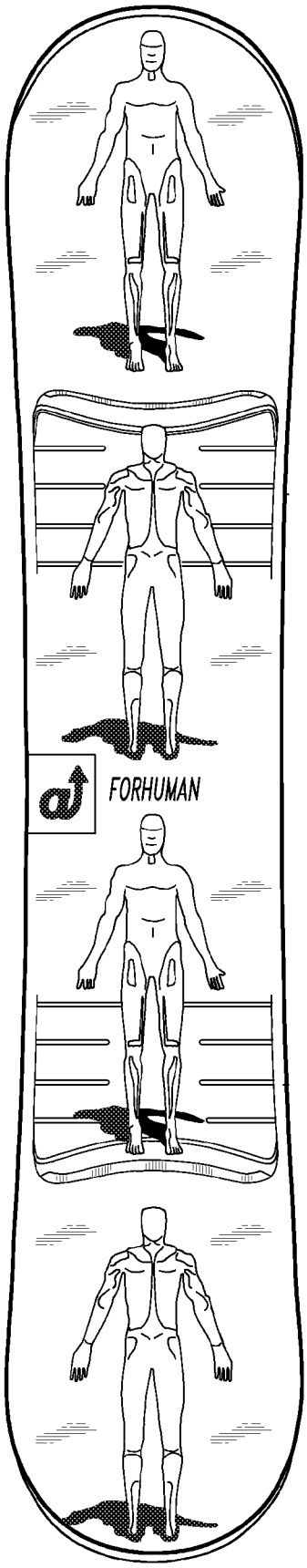
FIG. 26 shows flexible wedges having two transverse slots going across the binding area (one outside and one inside the binding area), but this time with one having an arced shape, as well as three sets of slots that are filled in the area substantially directly below the binding area containing the screw inserts, in accordance with the principles of the present invention.

FIG. 26 shows flexible wedges having two transverse slots going across the binding area (one outside and one inside the binding area), but this time with one having an arced shape, as well as three sets of slots that are filled in the area substantially directly below the binding area containing the screw inserts, in accordance with the principles of the present invention.

Figure 27:
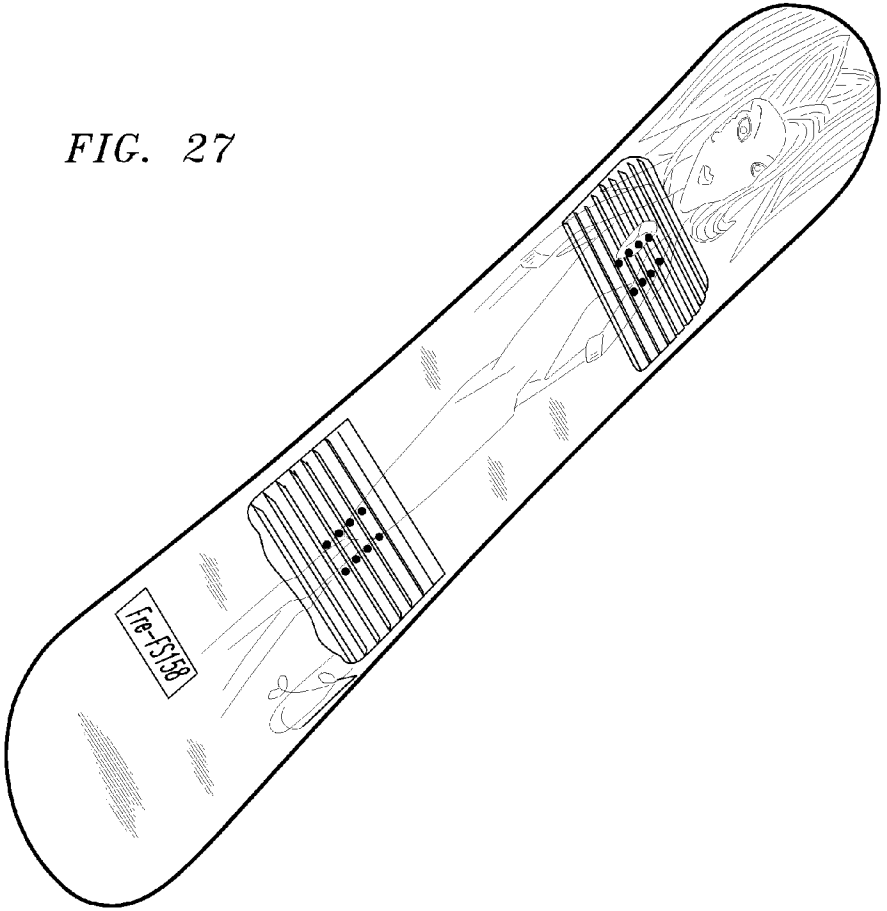
FIG. 27 shows flexible wedges having three transverse slots going across binding area (two outside and one inside the binding area), and five sets of slots that are filled in (or actually not formed) in the area substantially directly below the binding area containing the screw inserts, in accordance with the principles of the present invention.

FIG. 27 shows flexible wedges having three transverse slots going across binding area (two outside and one inside the binding area), and five sets of slots that are filled in (or actually not formed) in the area substantially directly below the binding area containing the screw inserts, in accordance with the principles of the present invention.

Figure 28:
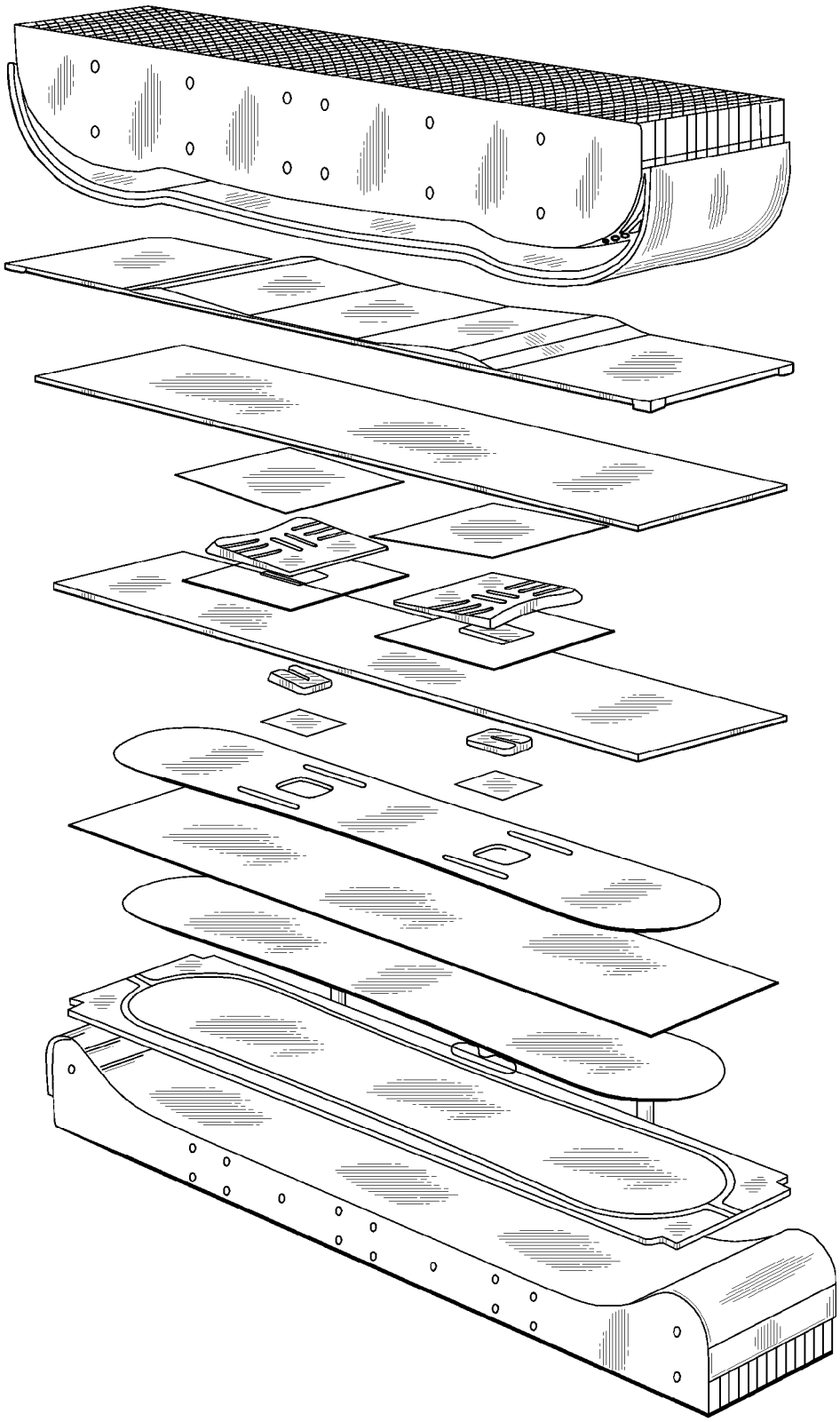
FIG. 28 is an exploded view of an exemplary assembly showing flexible wedges including slots both going across binding area and filled in directly below the binding area around where the inserts are placed, in accordance with the principles of the present invention.

FIG. 28 is an exploded view of an exemplary assembly showing flexible wedges including slots both going across binding area and filled in directly below the binding area around where the inserts are placed, in accordance with the principles of the present invention.

Figure 29:
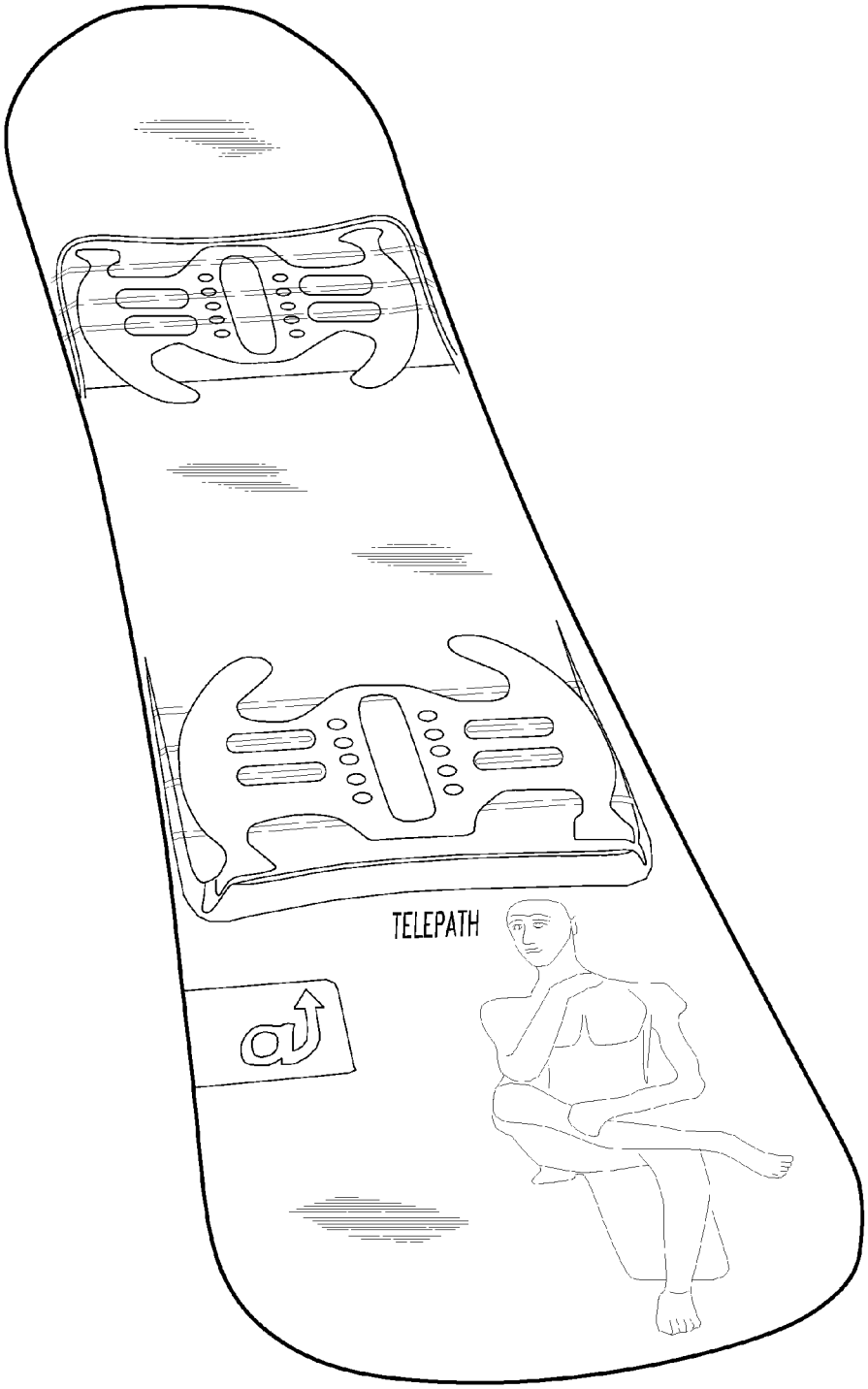
FIGS. 29, 30A and 30B show the adjustability of slots in a flexibility wedge, fine tuned by a user of the snowboard, in accordance with the principles of the present invention.
Figure 30A:
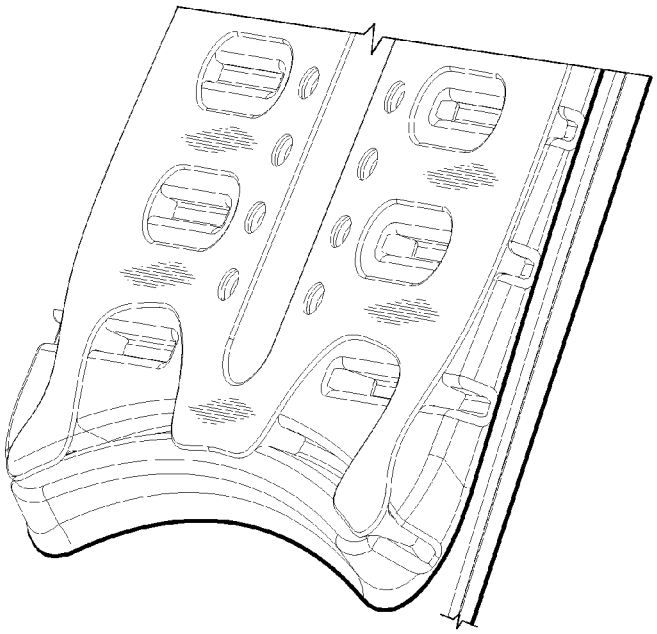
Figure 30B:
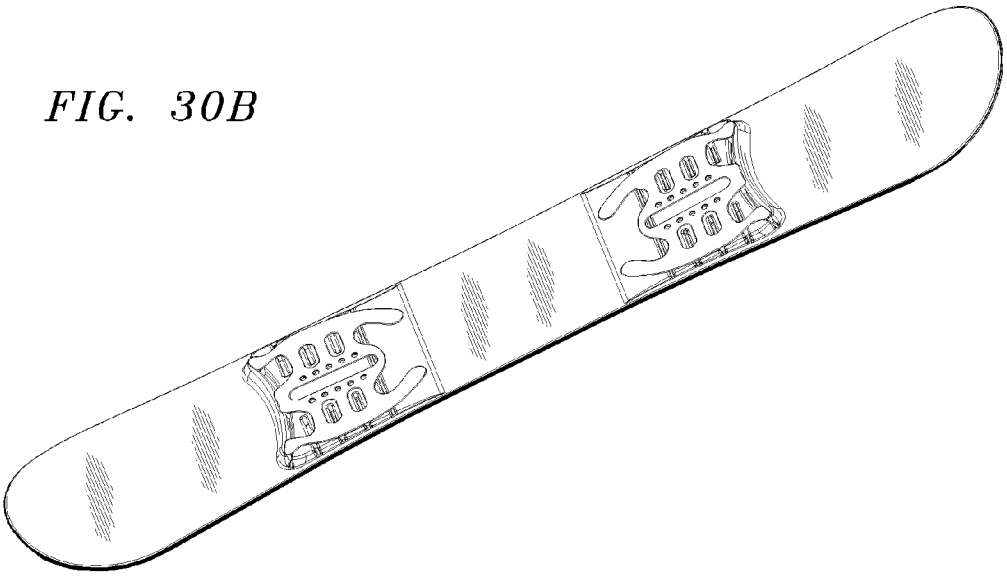

FIGS. 29, 30A and 30B show the adjustability of slots in a flexibility wedge, fine tuned by a user of the snowboard, in accordance with the principles of the present invention.

In particular, as shown in FIGS. 29, 30A and 30B, as a user customizable, additional feature, in accordance with the invention, rubber type material may be inserted into the flexibility slots to adjust the flexibility of the binding area of the snowboard. No insert would provide the most flexibility; a rubber insert fit snugly into one or more flexibility slots would dampen the flexibility accordingly, and a mostly solid insert fit snugly into one or more flexibility slots would severely dampen its flexibility.

Figure 31A:
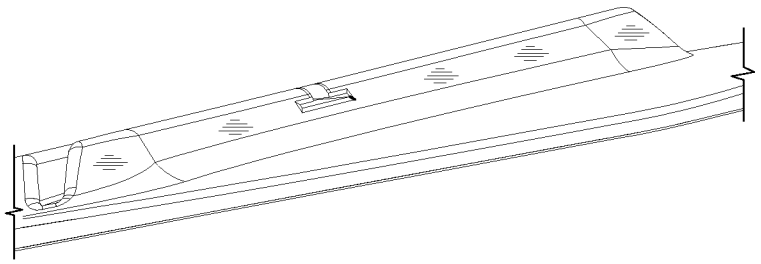
FIGS. 31A and 31B show that in accordance with another aspect of the invention, bindings may be mounted using a slide-in insert. The lengthwise insert slot (or slots) may be capped with a rubber type material.
Figure 31B:
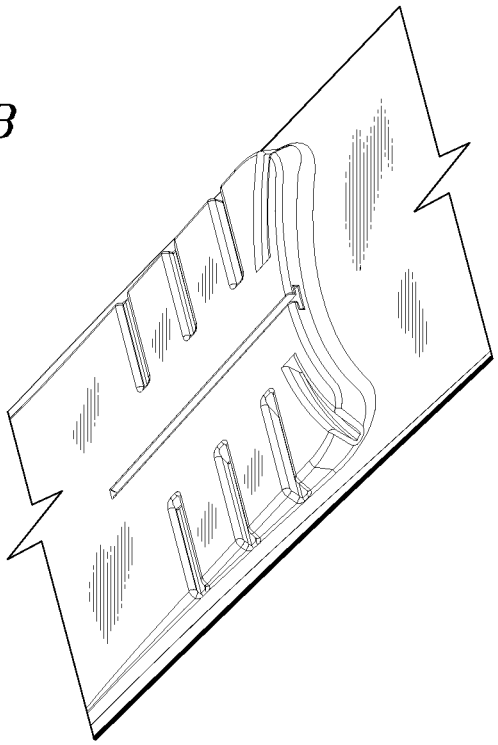
Figure 32:
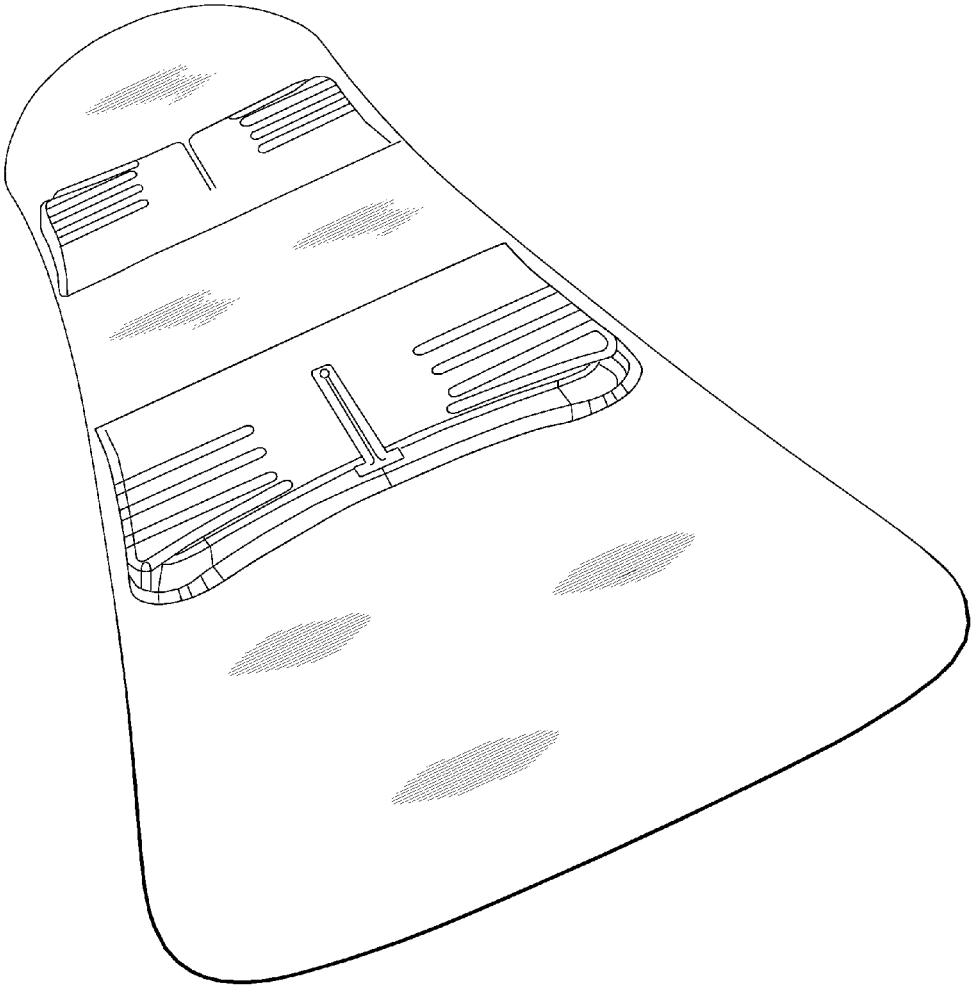
FIG. 32 to FIG. 44 show various embodiments of flexible binding wedges, in accordance with the principles of the present invention.
Figure 33:
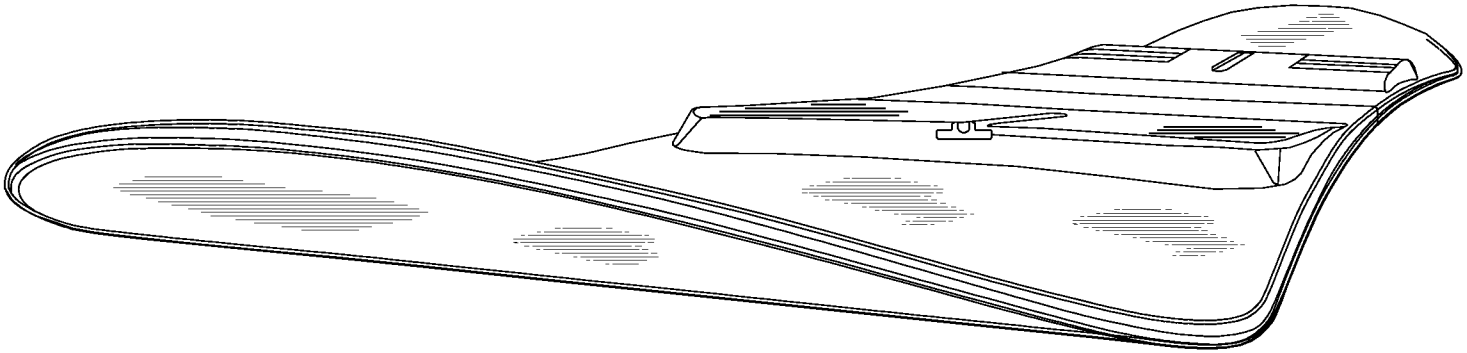
Figure 34:
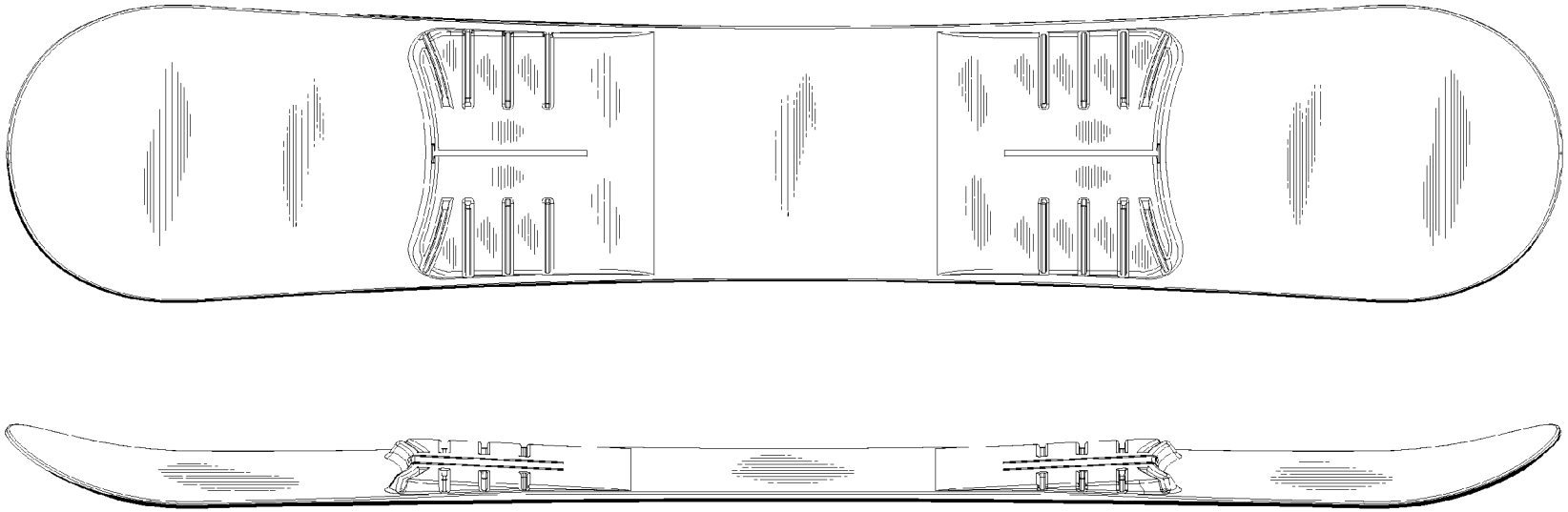
Figure 35:
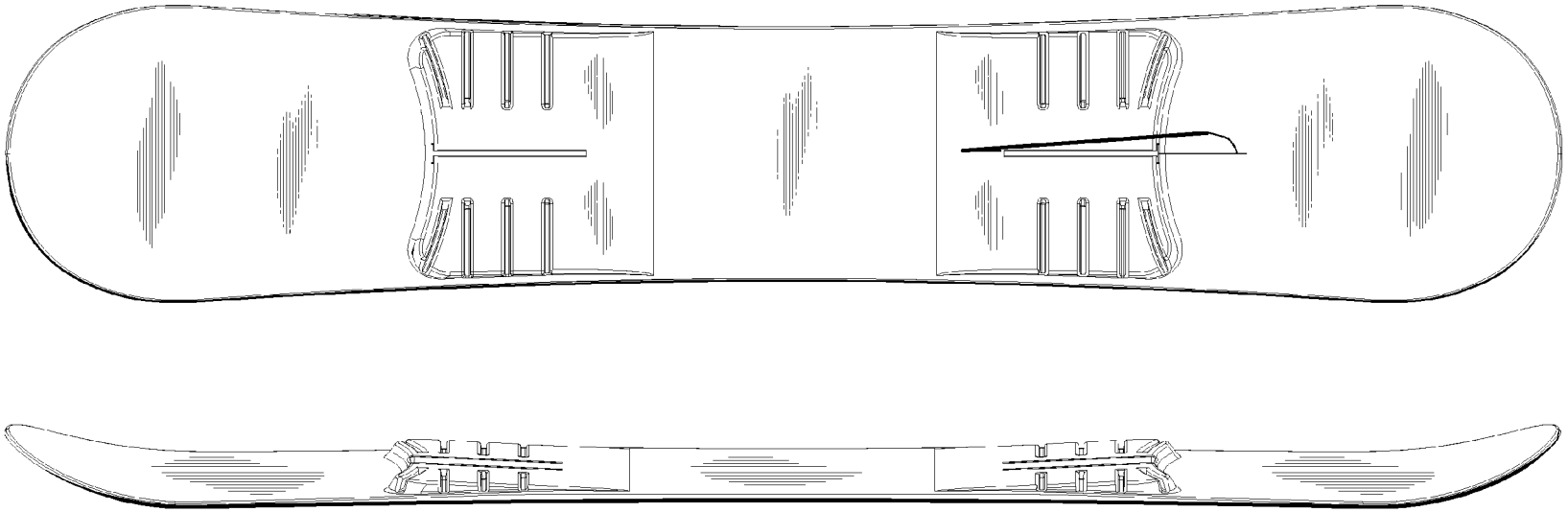
Figure 36:
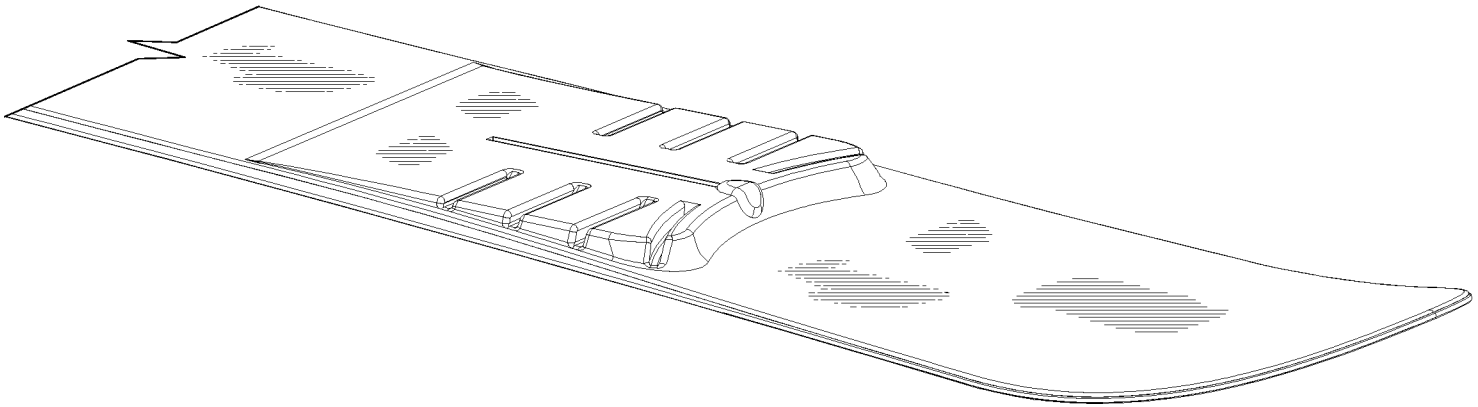
Figure 37:
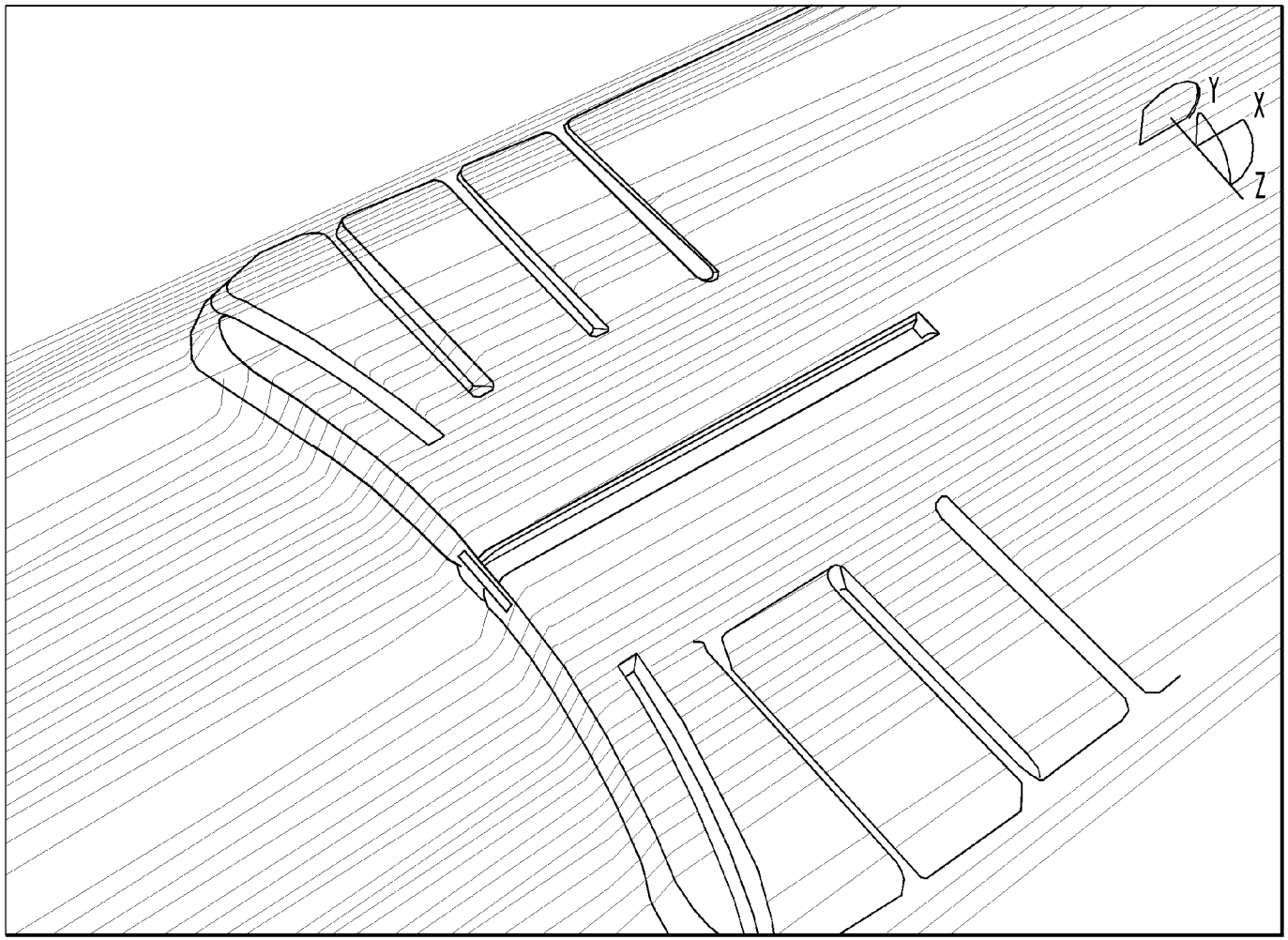
Figure 38:
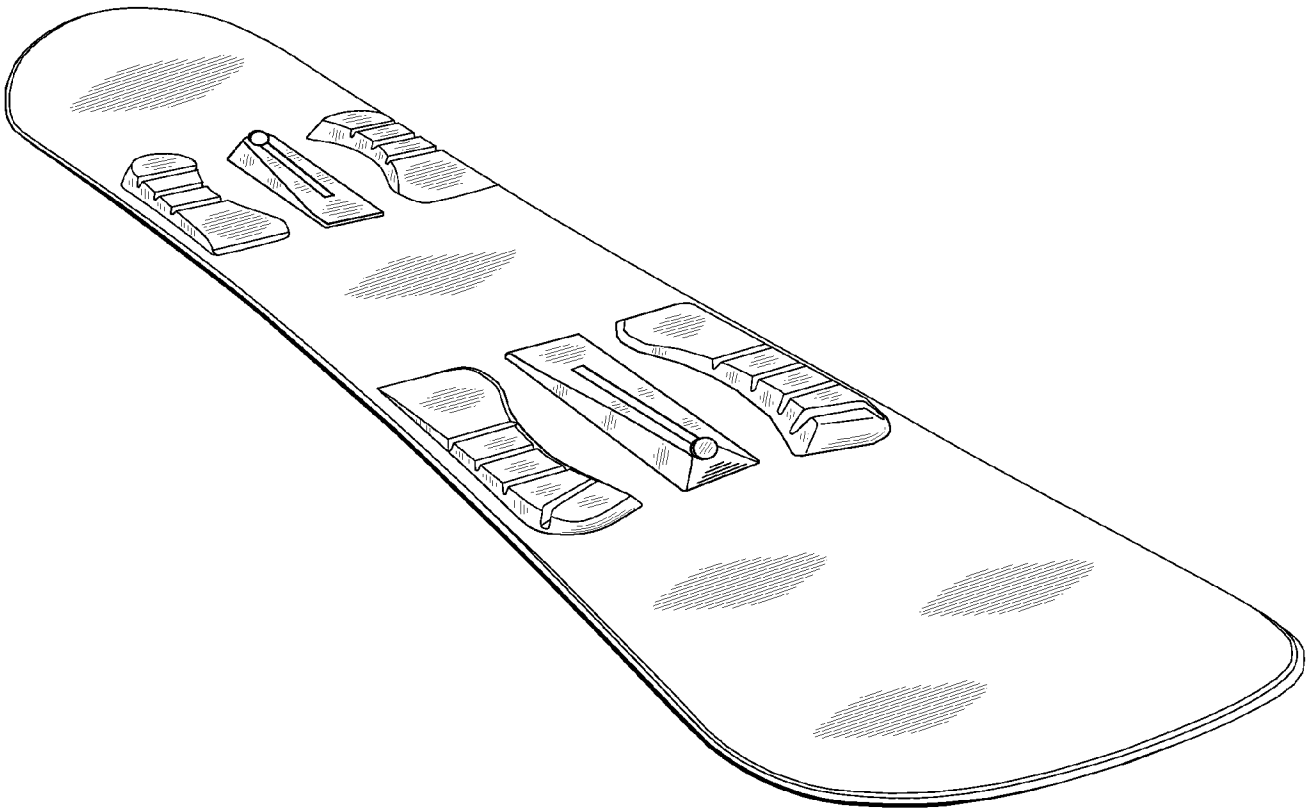
Figure 39:
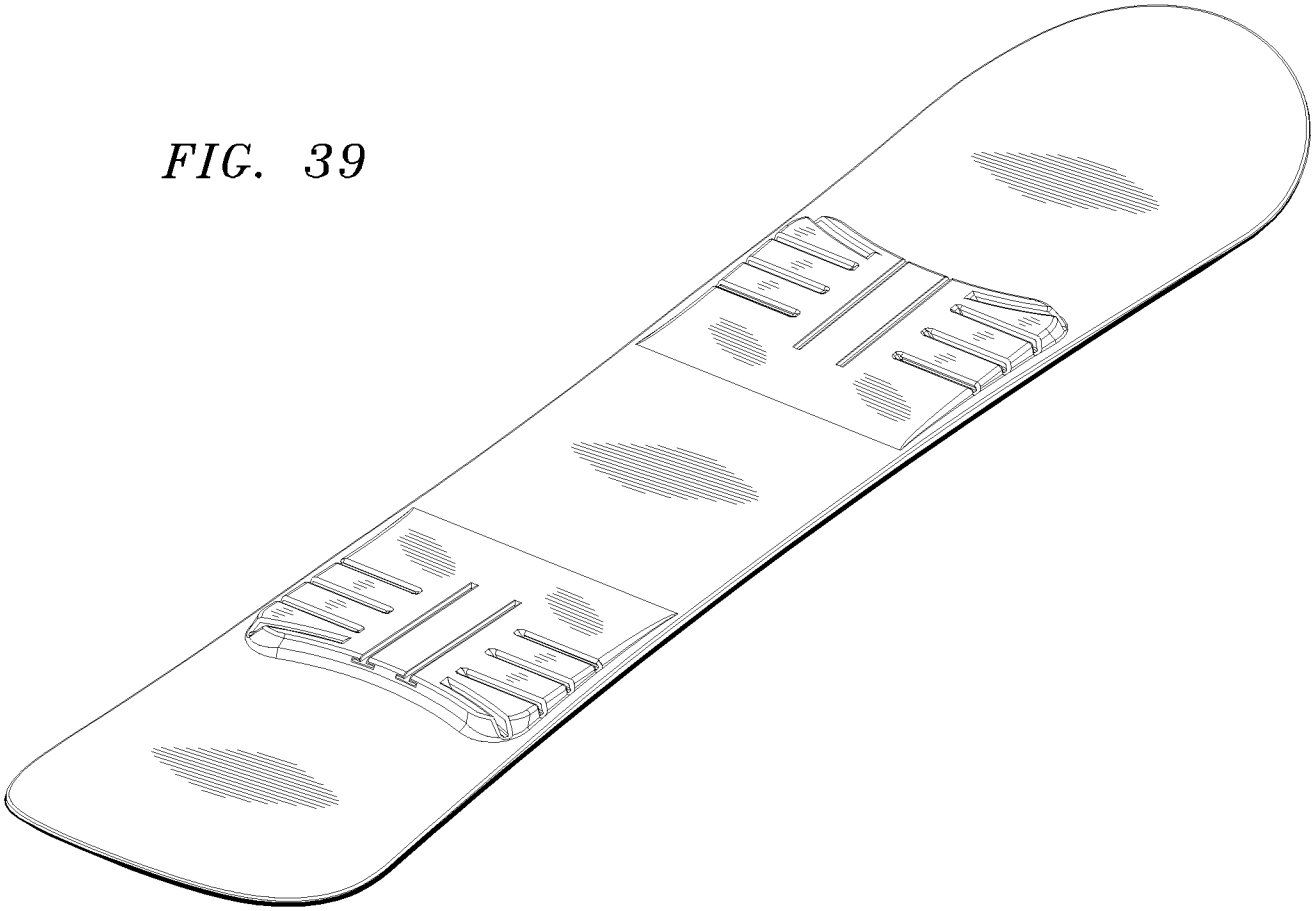
Figure 40:
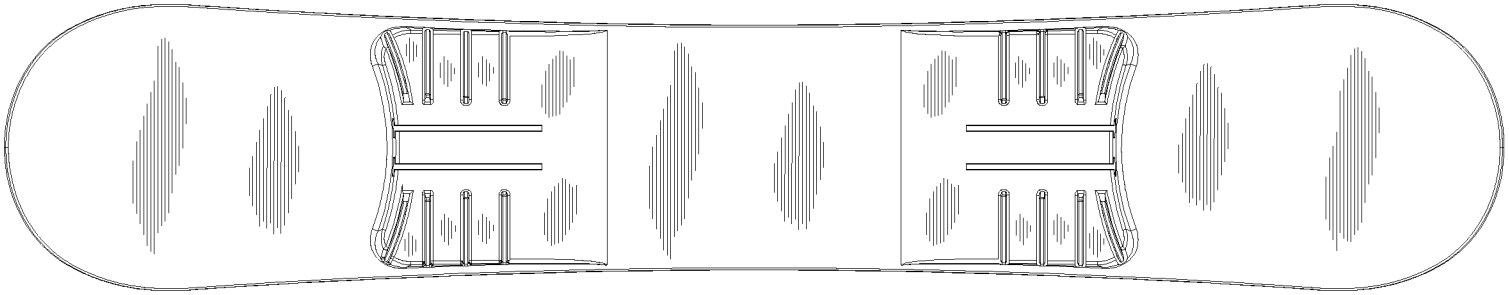
Figure 41:
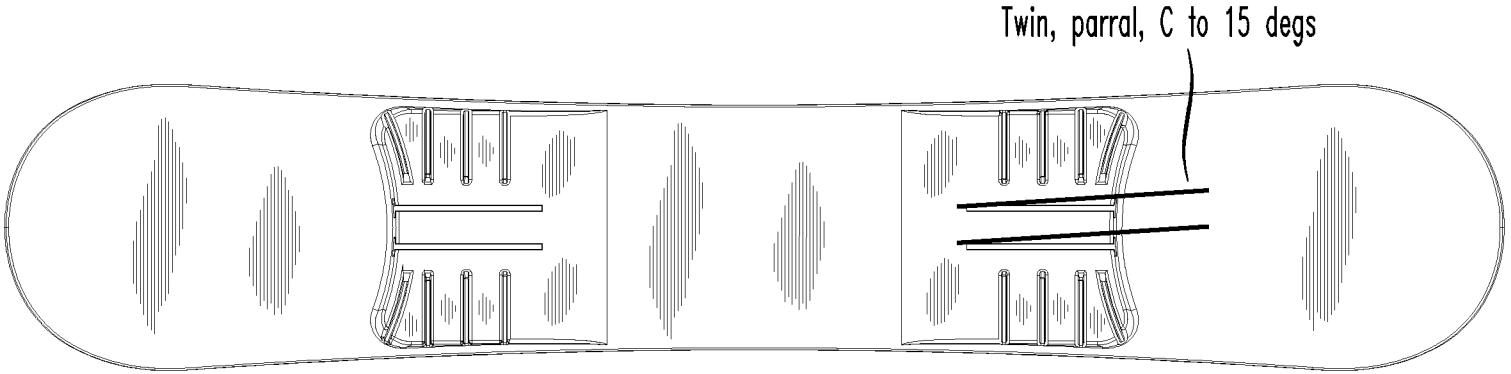
Figure 42:
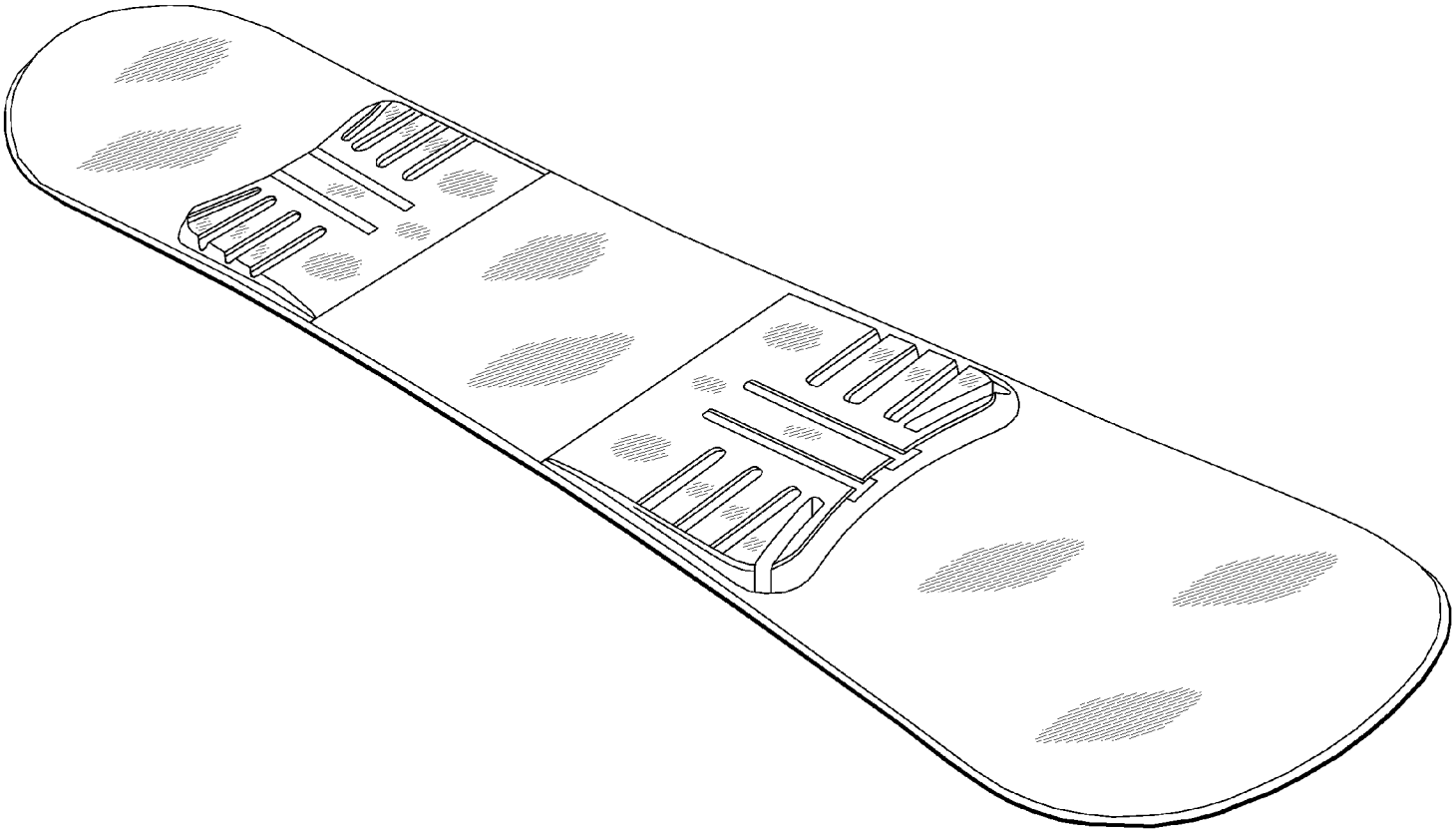
Figure 43:
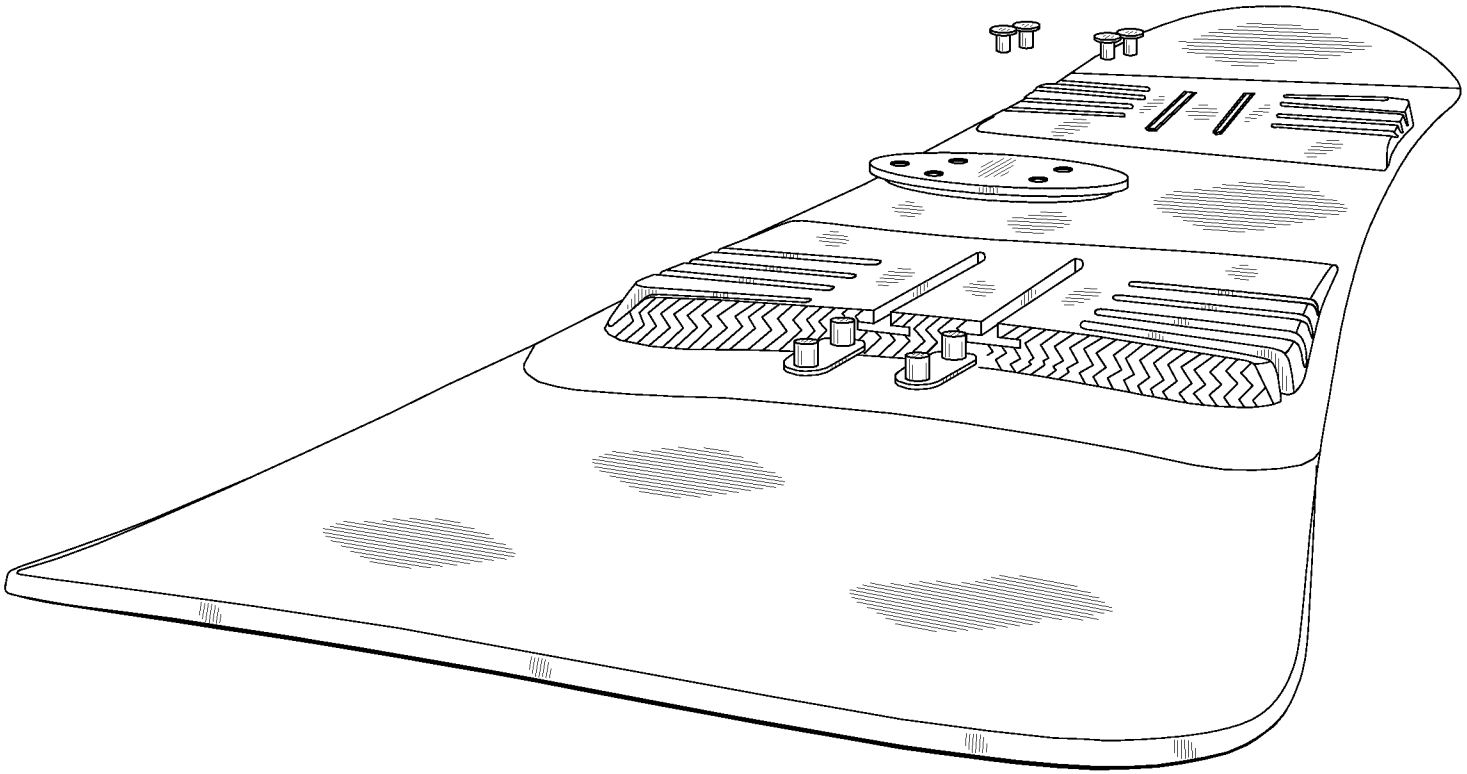
Figure 44:
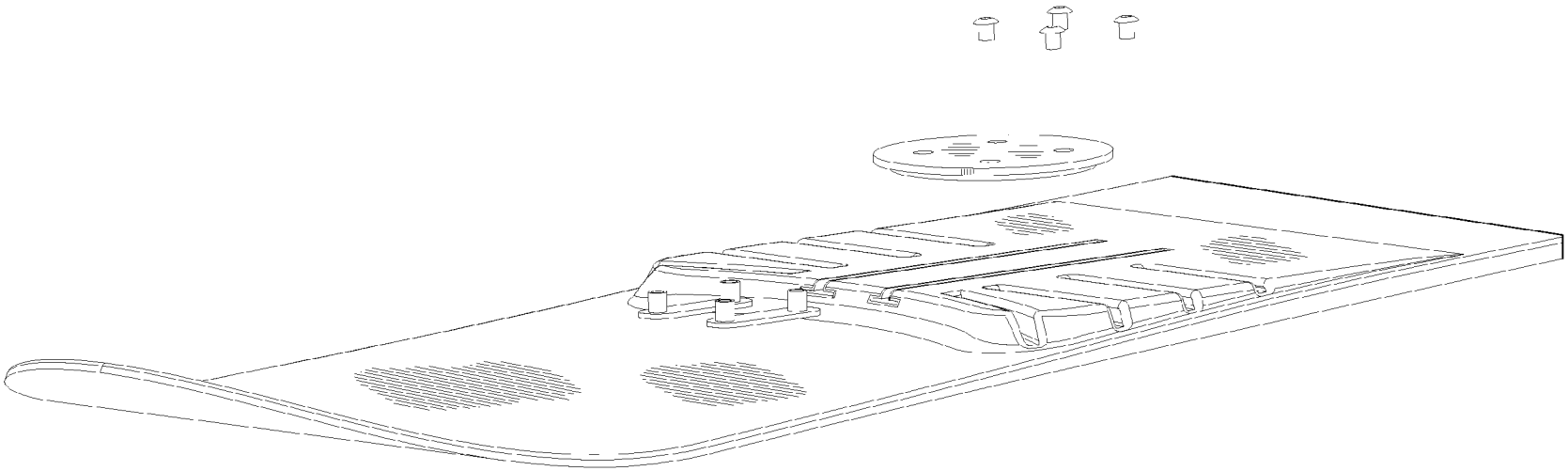

FIGS. 31A and 31B show that in accordance with another aspect of the invention, bindings may be mounted using a slide-in insert. The lengthwise insert slot (or slots) may be capped with a rubber type material.

FIG. 32 to FIG. 44 show various embodiments of flexible binding wedges, in accordance with the principles of the present invention.

The present invention provides an ergonomic snowboard that can be custom produced or mass produced with a one or multiple pieces core, with existing core machining/molding/forming machines, regardless of the material, yet have added flexibility otherwise caused by the use of binding wedges. The flexibility wedges provide an ergonomic snowboard that provides the same if not superior structural performances as a standard ergonomic snowboard or flat standard snowboard.

The ergonomic snowboard may be produced according to personalized anthropometric measurements per target population or individual rider, custom postural with a standard ergonomic wedge geometry that can be placed on/in any snowboard shape or construction main body. It is preferable that the ergonomic snowboard has the same look as conventional snowboards, with the important and notable exception of the use of postural, flexibility wedges, e.g., having slots, in accordance with the present invention.

The ergonomic snowboard preferably has the same surface, contour and/or edges construction and finish as conventional snowboards. Using conventional inserts, the ergonomic snowboard may accommodate all conventional binding types.

The postural, flexibility wedges have angles preferably as described in U.S. Pat. No. 6,499,758 (co-owned by the present inventor), but importantly have flexibility slots cut thereacross. The flexibility wedges may be machined or molded or cast in any material, reinforced or not by a covering material.

As shown, the flexibility wedges have a thick portion at one end that goes to nothing toward the other end in the lengthwise axis. The flexibility wedges are installed on a main core body with the thin portion toward the center of the main body.

The flexibility wedges having transverse slots have an upper planar surface or slightly curved surface that is at an angle from the gliding surface (e.g., snow or flat ground) (i.e., it is not 100% planar once the snowboard having flexibility wedges is removed from its manufacturing mould).

The angle of the upper surface of the flexibility wedges is between about 0.5 degrees to 20 degrees from a side view, and between about 1 to 10 degrees from a front aligned view.

The flexibility wedges have a lower contacting surface that is not necessarily planar, and not necessarily horizontal.

Wedges are formed or placed perpendicular or almost perpendicular to the lengthwise axis of the snowboard. The flexibility wedges include flexion slots or grooves in the upper surface that are made linear or slightly radial (flexion slot made with a long radius arc or any curved spline instead of straight perpendicular grooves.) The flexion slots can be with or without chamfer angles or filets on contour walls and edges bellow or above, so there can be a discontinuity between flexion slot or grooves.

There can be one, two or many machined or moulded openings in the upper wedge surface parallel from 0 to 15 degrees to the lengthwise axis parallel or not. Openings or slots do continue beyond the boundaries of the highest portion of the wedged snowboard surface, and do pierce the most exterior side wall or side surface enabling sliding effect for the anchoring system for the binding's system removal/installation, without dismantlement of the binding anchoring system or bindings screws. A plurality of binding anchoring hardware can be used to fit a corresponding plurality of lengthwise slots.

The flexibility wedges can be screwed in/on or glued to the reinforced and or finished surface of a snowboard, regardless of the shape of the surface of the core (w/pre-threaded holes).

As seen from above, flexibility wedges can be of any suitable circumferential shape, with or without chamfer angles or filets on contour walls and edges below or above etc, and they can have any suitable surface finish.

As seen from below, the flexibility wedge is a hollow structure with machined or moulded ribs, or multiples slots or drilled holes or any hollowing cavities for light weight and strong at specific area.

A centered, under portion exceeds the main body of the wedge to enable the insertion and alignment of the wedge in the receiving main body core or any core part or main core body of the snowboard.

This centered under portion that exceeds the main body of the wedge has it's lower surface parallel to the upper surface, and provides for adherence to the main core body and strength for the installation of long treaded T inserts, and the like.

For the attachment of the miscellaneous binding systems currently available to a finished snowboard including flexibility wedges on a core thereof, the flexibility wedges can have one hole or many holes in different patterns. The traversing holes are preferably always perpendicular to the above surface of the wedge, even if other reinforcement or surface material do cover the wedge. Thus, the binding inserts are NOT perpendicular to the lower surface of the snowboard, but instead ARE perpendicular to the upper surface of the flexibility wedge.

For the attachment of the miscellaneous binding systems currently available to a finished snowboard, the flexibility wedge can have one slot or many slots, long or short, parallel or not to the lengthwise axis of the snowboard. This enables movement of the threaded insert for them to move freely, allowing for micro adjustments. As disclosed, cavities created by the slots are always perpendicular to the above surface of the wedge, even if other reinforcement or surface material does cover the wedge.

The flexibility wedge can have an exceeding lower portion surface extrapolating toward the outside of it's perimeter for added contact to the main core body.

The flexibility wedges are located on the finished snowboard or main core body, at the very stance of a snowboarder according to it's anthropometry for the best postural position.

The main core and/or any other contacting core pieces can be made of any suitable known material or engineered material.

The upper surface of the main core body has a machined, or molded in, or grooved in, cavity or cavities to receive the lower portion of the flexibility wedges. This cavity can go all the way through the main core body in some case.

The core can have an added means of reinforcement between the flexibility wedges and the core receiving cavity.

The overall lower, under-core surface can also include hollow structure, with machined or molded ribs, or multiples slots or drilled holes or any hollowing cavities for light weight.

The upper surface of the main core body can be of any shape, most particularly composed of, e.g., 4 main depressions in thickness, two at the approx location of the middle wedges areas, and two for both ends. (E.g., thin at one end, thicker toward and close to the wedge front, thin toward the middle of the first wedge, then thicker toward the middle of the main core body, then thinner toward and about at the middle of the other wedge, then thicker passed the wedge and thinner toward the other far end of the main core body.)

The upper variation in thickness is made from machined or molded surface curvature that are all tangent to avoid deflexion irregularities and or breakage of the body once merged with the wedges.

The same variation in thickness' purpose is to send compression forces from the thicker portion of the main core body to the middle of the wedges, and to enable the main core body to have a plurality of controlled flexion and torsion zones.

The main core body can have its entire perimeter or partial perimeter protected by waterproof contour, generally of plastic or reinforced plastic or any other impact resistant and waterproof material.

The main core body can have slots or orifice through it from the upper surface to the lower surface thus slot to be filled with a shear or impact resistant material avoiding wedge penetration into the main core body.

Slots can be of any shape and dimensions and are located about the location of the wedges close to the perimeter of the main core body.

Standard known reinforcement in contact with the entire contour surface perimeter at 90 degree angle or less, of the main core body, and, or between the main core body and the perimeter protection material, in case of main core body without total or partial contour protection (what is called cap snowboard).

Standard known reinforcement above the completed wedge and main core body assembly, the reinforcement goes above and around the wedge and also rest on the other previous reinforcement or in direct contact with the main core body.

Standard known reinforcement under the form of strips, above and around the lower edge of the wedges perimeter and up the contouring wedge' outside contour walls.

Standard known reinforcement under the form of strips above and in contact with the lower edge of the wedges at the bottom of the thickest portion of wedge for use with and when top sheet is installed direct on wedge (reinforcement in front of wedge at the bottom of the thicker portion).

Standard known reinforcement inserted in the main core body traversing slots at the wedges location (to avoid wedge penetration into the main core body, following harsh riding impact).

Standard known fiber reinforcement under the form of a plurality of strips and layers, above, around, under, wrapping the slots tracks (aluminum or plastic, or reinforced composite) or slot sub frame track, the anchoring system will slide in this track. Track are to be machine afterwards for more accuracy.

Standard known plastics materials, or thermoset materials available in the industry, may be used for the top or base, with or without cosmetics.

Any hydro formed or mold formed non-ferrous material may be used on the top or base, with or without cosmetics.

Surface materials can be reinforced or plain (e.g., reinforced thermoplastics), thermoformed or plain.

The snowboard may have one end wider than the other one (taper shape). The lateral cut or side cut may be made with a besier curve or 3 point mathematic spline (orange curves).

In addition to the spline, the ergonomic snowboard may have a straight line that starts about the middle of the wedge, all the way to about the widest point of the snowboard. This line is preferably always parallel to a similar straight line at the other opposite end, and mirrors the other side.

The flexibility wedge contours are preferably mostly round shape by multiple radiuses, and may also have some other multiple radiuses or any geometric shape protuberances on it's contour mostly at the end of the thicker portion.

As an additional feature, in accordance with the invention, rubber type material may be inserted into the flexibility slots to adjust the flexibility of the binding area of the snowboard. No insert would provide the most flexibility; a rubber insert fit snugly into one or more flexibility slots would dampen the flexibility accordingly, and a mostly solid insert fit snugly into one or more flexibility slots would severely dampen its flexibility.

While the invention has been described with reference to the exemplary embodiments thereof, those skilled in the art will be able to make various modifications to the described embodiments of the invention without departing from the true spirit and scope of the invention.

What is claimed is:

1. Apparatus to provide an ergonomic stance to a rider on a sportsboard, comprising:

a flexible slotted wedge formed to mount over a top surface of a core of a sportsboard in a binding mounting area, said flexible slotted wedge including at least one slot in a width direction of said sportsboard, and being shaped to angle a leg of a rider inward from a perpendicular position; and at least one mounting slot in a length direction of said flexible slotted wedge to accept a restraint for mounting a boot binding thereinto, said mounting slot having entry for said restraint via an outside edge of said flexible slotted wedge.

2. The apparatus to provide an ergonomic stance to a rider on a sportsboard according to claim 1, wherein:

said at least one mounting slot is perpendicular to said at least one slot in a width direction of said sportsboard.

3. The apparatus to provide an ergonomic stance to a rider on a sportsboard according to claim 1, wherein:

said sportsboard is a snowboard.

4. The apparatus to provide an ergonomic stance to a rider on a sportsboard according to claim 1, wherein:

said boot binding is a snowboard binding.

5. The apparatus to provide an ergonomic stance to a rider on a sportsboard according to claim 1, wherein:

said angle is between 1 and 20 degrees.

6. The apparatus to provide an ergonomic stance to a rider on a sportsboard according to claim 1, further comprising:

at least one arced transverse slot generally widthwise across said binding mounting area.

7. Apparatus to provide an ergonomic stance to a rider on a sportsboard, comprising:

a flexible slotted wedge formed to mount over a top surface of a core of a sportsboard in a binding mounting area, said flexible slotted wedge including at least one slot in a width direction of said sportsboard, and being shaped to angle a leg of a rider inward from a perpendicular position; and at least one mounting slot in a length direction of said flexible slotted wedge to accept a restraint for mounting a boot binding thereinto, said mounting slot having entry for said restraint via an outside edge of said flexible slotted wedge;

wherein said flexible slotted wedge includes a laterally extending corner portion extending beyond rectangular in a direction generally diagonal from a rectangular shape formed by said at least one mounting slot.

8. The apparatus to provide an ergonomic stance to a rider on a sportsboard according to claim 7, wherein:

said extending corner portion is symmetrical with respect to a length direction of said sportsboard, to an adjacent corner of said slotted wedge.

9. The apparatus to provide an ergonomic stance to a rider on a sportsboard according to claim 1, wherein:

said slotted wedge has a thinning profile at an edge nearest a lengthwise end of said sportsboard.

10. The apparatus to provide an ergonomic stance to a rider on a sportsboard according to claim 1, wherein:

said flexible slotted wedge includes a plurality of slots in said width direction.

11. The apparatus to provide an ergonomic stance to a rider on a sportsboard according to claim 1, wherein:

said flexible slotted wedge includes at least three slots in said width direction.

12. The apparatus to provide an ergonomic stance to a rider on a sportsboard according to claim 1, wherein said at least one mounting slot comprises two mounting slots in said length direction.

* * * * *